US008544764B2

(12) United States Patent
Cooke

(10) Patent No.: US 8,544,764 B2
(45) Date of Patent: Oct. 1, 2013

(54) FUEL INJECTOR AND OPERATING METHOD THEREFOR

(75) Inventor: Michael Peter Cooke, Gillingham (GB)

(73) Assignee: Delphi Technologies Holding S.arl, Luxembourg (LU)

( * ) Notice: Subject to any disclaimer, the term of this patent is extended or adjusted under 35 U.S.C. 154(b) by 677 days.

(21) Appl. No.: 12/357,634

(22) Filed: Jan. 22, 2009

(65) Prior Publication Data

US 2009/0184176 A1 Jul. 23, 2009

(30) Foreign Application Priority Data

Jan. 22, 2008 (EP) ..... 08001567

(51) Int. Cl.
*F02D 1/06* (2006.01)

(52) U.S. Cl.
USPC ..... 239/5; 239/4; 239/96; 239/102.2

(58) Field of Classification Search
USPC ..... 239/5, 88, 585.1–585.5, 4, 96, 102.2; 310/317, 324; 251/129.06
See application file for complete search history.

(56) References Cited

U.S. PATENT DOCUMENTS 4,398,204 A * 8/1983 Dietrich et al. ..... 347/68
4,767,959 A * 8/1988 Sakakibara et al. ..... 310/317
5,986,360 A * 11/1999 Gerken et al. ..... 307/125
6,739,575 B2 * 5/2004 Cotton et al. ..... 251/129.06
2004/0173694 A1 9/2004 Cooke
2006/0012265 A1 * 1/2006 Bachmaier et al. ..... 310/316.01

FOREIGN PATENT DOCUMENTS

| | | |
|---|---|---|
| DE | 19519191 | 12/1996 |
| DE | 102004046080 | 4/2006 |
| DE | 102005054386 | 5/2007 |
| EP | 1555427 | 7/2005 |
| EP | 1693562 | 8/2006 |
| EP | 1837518 | 9/2007 |
| GB | 2366664 | 3/2002 |

OTHER PUBLICATIONS

European Search Report dated Feb. 12, 2008.

* cited by examiner

*Primary Examiner* — Steven J Ganey
(74) *Attorney, Agent, or Firm* — Thomas N. Twomey

(57) ABSTRACT

A method of operating a fuel injector having a piezoelectric actuator for controlling movement of an injector valve needle comprises: (a) prior to an initial fuel injection event, reducing the voltage across the actuator at an initial rate so as to de-energize the actuator; (b) increasing the voltage across the actuator at a first rate in order to initiate an initial fuel injection event of a first fuel injection sequence; and (c) reducing the voltage across the actuator at a second rate in order to terminate the initial fuel injection event. The method may further comprise the step of: (d) increasing the voltage across the actuator at a third rate, which is lower than the first rate, so as to de-energize the actuator but without initiating an injection event, once the initial fuel injection event has terminated and before a subsequent fuel injection event is initiated. The method can be employed particularly to improve actuator lifespan, operating efficiency and/or performance in an energize to inject fuel injector.

21 Claims, 9 Drawing Sheets

FUEL INJECTOR AND OPERATING METHOD THEREFOR

FIELD OF THE INVENTION

The invention relates to a fuel injector for use in the delivery of fuel to a combustion space of an internal combustion engine. In particular, the invention relates to a piezoelectric-actuated fuel injector of the energise to inject type, and to a method of operating it to allow large piezoelectric stroke lengths while preserving actuator performance and/or lifespan.

BACKGROUND OF THE INVENTION

In an internal combustion engine, it is known for a fuel pump to supply fuel to a high-pressure accumulator (or common rail), from which it is delivered into each cylinder of the engine by means of a dedicated fuel injector. Typically, a fuel injector has an injection nozzle which is received within a bore provided in a cylinder head of the cylinder; and a valve needle which is actuated to control the release of high-pressure fuel into the cylinder from spray holes provided in the nozzle.

It is known to provide a fuel injector for an automotive engine with a piezoelectric actuator for controlling the injection of fuel into the engine. A piezoelectric actuator of the type used in a fuel injector includes a stack of piezoelectric layers (or elements) that are separated by a plurality of internal electrodes. The actuator includes positive and negative external electrodes that respectively connect to alternate internal electrodes, such that positive and negative internal electrodes interdigitate along the length of the piezoelectric stack, with a layer of the piezoelectric material in-between.

In use, an electrical connector having positive and negative terminals provides a voltage to respective positive and negative external electrodes, which produces an intermittent electric field between adjacent interdigitated electrodes. The intermittent electric field can be rapidly varied with respect to its strength, which in turn causes the stack of piezoelectric layers to extend and contract along the direction of the applied field.

Within a fuel injector, the lowermost piezoelectric layer of the stack is adjacent to a lower end cap and the uppermost piezoelectric layer of the stack is adjacent to an upper end cap. The lower end cap is coupled to an injector valve needle, either directly or through an intermediate mechanical and/or hydraulic coupling. In this way, the piezoelectric actuator is arranged to control movement of an injector valve needle towards and away from a valve seating, so as to control the injection of fuel. Advantageously, piezoelectric actuators thus allow accurate control over the amount of valve needle movement towards and away from the valve needle seat and, hence, over the rate of fuel injection.

Piezoelectric injectors come in both "de-energise to inject" (e.g. EP 0995901; EP 1174615) and "energise to inject" (e.g. EP 1555427) varieties. By way of example, in a de-energise to inject fuel injector, such as that described in EP 1174615, as the piezoelectric stack extends and contracts upon application and removal of the electric field, respectively, the injector valve needle is similarly caused to move away and towards the injector valve seat.

In use, fuel is prevented from being injected into an associated engine cylinder when the injector valve needle is securely engaged with its injector valve seat. In a de-energise-to-inject injector, such as that in EP 1174615, this is achieved by applying a voltage of approximately 250 V to the positive internal electrodes and approximately 50 V to the negative internal electrodes to give a differential voltage (or potential difference) of approximately 200 V across the electrodes. This level of differential voltage causes an appropriate extension of the piezoelectric stack, such that the injector valve needle remains in contact with the injector valve seat. Since fuel injection events are typically short in relation to the operating cycle of a fuel injector, the fuel injector needle is engaged with its associated valve seat for approximately 95% of the operating cycle of the fuel injector.

To inject fuel into the cylinder the differential voltage across the positive and negative internal electrodes is rapidly reduced, causing the piezoelectric stack to contract. The pressure of the fuel and the amount of fuel that it is intended to inject determines the required level of voltage reduction. For example, at a minimum fuel pressure of around 200 bar (such as when the engine is idling), the voltage applied to the positive internal electrodes may be reduced to approximately 20 V; while at a maximum pressure of around 2000 bar, the voltage applied to the positive internal electrodes may be reduced to approximately −20 V, briefly making the positive internal electrodes negative (i.e. a bipolar mode of operation).

An significant advantage of this type of injector drive system is that bipolar operation, in which the voltage on the piezoelectric actuator is allowed to go negative during an injection, can be used to generate a larger stroke from the actuator than would otherwise be possible.

However, de-energise to inject systems suffer the disadvantage that for the majority (approximately 95%) of its operating life, i.e. while the injector is not injecting, the piezoelectric actuator stack must be maintained at a high positive differential voltage (e.g. 200 V). If moisture, for example, is present within the actuator, this high positive voltage can cause electrochemical degradation of the piezoelectric material, resulting, after time, in a short circuit failure and, hence, a reduced effective operational lifespan.

By contrast, an energise to inject injector (such as that described in EP 1555427) does not suffer as badly from electrochemical degradation, because it is only held at a high positive voltage during the 5% or so of time that it spends injecting. This type of prior art injector, however, cannot be run with significant bipolar voltages, since maintaining a negative voltage on the piezoelectric actuator for 95% of its operational life would result in actuator depolarisation, causing high electrical losses plus reduced actuator life and performance. Accordingly, prior art energise to inject piezoelectric-actuated fuel injectors do not so readily allow for large actuator displacements, which can be particularly disadvantageous where large fuel injections are required.

Another factor to consider is that prior art piezoelectric injectors require a relatively large and expensive piezoelectric actuator to provide the energy needed to lift the needle. Coupled with the fact that the amount of needle lift is limited by the capabilities of the actuator (even if a hydraulic amplifier is used to try to alleviate this problem), and any injector drive system limitations; the loss of the bipolar mode of operation in prior art energise to inject injectors severely limits the effectiveness of these injectors, particularly as injector nozzle flow requirements and fuel pressures increase.

Hence, there is a need for a fuel injector and a method of operating a fuel injector, in particular an energise to inject injector, which can enable the beneficial large actuator displacements achieved in de-energise to inject injectors, while reducing the possibility of any undesirable reductions in actuator response and lifespan.

This invention relates to a method for operating a piezoelectric energise to inject injector so as to overcome or at least alleviate at least one of the above-mentioned problems in the prior art.

SUMMARY OF THE INVENTION

In broad terms, the invention provides a fuel injector and a drive strategy for a fuel injector, which achieves some of the benefits of de-energise to inject fuel injector designs, while reducing one or more disadvantages associated with such known systems. In part, the invention further provides a fuel injector and a drive strategy for a fuel injector, that provides the advantages of energise to inject fuel injectors, but without the limitations on the range of differential voltages that can be employed. In one respect, the invention provides a method for operating a piezoelectric-actuated fuel injector, which allows large differential voltage changes and, hence, large actuator displacements, while avoiding the need to maintain large positive differential voltages across the actuator for the majority of its operational life. More specifically, the invention relates to a drive strategy for a piezoelectric-actuated energise to inject injector, which permits negative voltages to be used to increase piezoelectric stack displacement, but without a significant risk of expediting the depolarisation of the actuator. In this way, one or more advantages over the prior art may be achieved, for example: a bipolar mode of operation can be employed in an energise to inject injector, to increase actuator displacement and valve needle lift; since it is not necessary to maintain the actuator at a negative voltage for a prolonged period of time, the actuator is not rapidly depolarised; since the actuator is not maintained at a large positive voltage for the majority of its operational life, it is not so prone to piezoelectric degradation; actuator operational lifespan can be increased; energy efficiency can be increased.

Accordingly, in a first aspect the invention provides a method of operating a fuel injector having a piezoelectric actuator for controlling movement of an injector valve needle, the method comprising: (a) prior to an initial fuel injection event, reducing the voltage across the actuator at an initial rate (RT0; RT0') so as to de-energise the actuator; (b) increasing the voltage across the actuator at a first rate (RT1) in order to initiate an initial fuel injection event of a first fuel injection sequence; and (c) reducing the voltage across the actuator at a second rate (RT2) in order to terminate the initial fuel injection event.

Suitably, step (a) comprises applying an initial discharge current ($I_{INI}$; $I_{INI'}$) to the actuator for an initial period (T-2 to T-1) so as to discharge the stack from an initial differential voltage level ($V_{-1}$) across the stack to a first differential voltage level ($V_0$) across the stack. Step (b) may comprise applying a charge current ($I_{CHARGE}$) to the actuator for a charge period (T0 to T1) so as to charge the stack from the first differential voltage level ($V_0$) across the stack to a second differential voltage level ($V_1$; $V_2$) across the stack. Step (c) may comprise applying a discharge current ($I_{DISCHARGE}$) to the actuator for a discharge period (T2 to T3) so as to discharge the stack from the second differential voltage level to a third differential voltage level ($V_3$).

The methods of the invention may be used to operate a piezoelectric fuel injector, and more particularly, an energise to inject piezoelectric fuel injector, in which the actuator is coupled to the injector valve needle by a load transmission arrangement that inverts the movement of the piezoelectric actuator with respect to the consequential movement of the valve needle. For example, a hydraulic coupling comprising an injection control chamber for fuel may be employed as a suitable load transmission arrangement; whereby extension and contraction of the actuator results in an increase or decrease in the fuel pressure within the control chamber, respectively, and movement of the valve needle away and towards the valve needle seat, respectively, to control injection through one or more injector nozzle outlets (a set of nozzle outlets). Thus, in an energise to inject injector, energisation of the actuator results in an extension of the actuator, which in turn causes the valve needle to lift to commence injection (i.e. to start a fuel injection event). In addition, the change in fuel pressure within the control chamber determines the position of the valve needle relative to the valve needle seat and, hence, the state of engagement between the valve needle and the valve needle seat.

In normal operation of such a fuel injector having an injection control chamber, in order to initiate an injection event the actuator is energised at a relatively high rate (i.e. the differential voltage across the actuator is increased rapidly), causing a relatively fast increase in fuel pressure within the control chamber and opening movement of the valve needle. To terminate the injection event the differential voltage across the actuator is reduced (i.e. the actuator is de-energised), typically at a high rate so as to cause a relatively rapid decrease in fuel pressure in the control chamber and a sharp end to the fuel injection event. The rapid de-energization of the actuator causes a consequential rapid closing movement of the valve needle towards the valve needle seat and, at a certain level of de-energisation (i.e. at a particular low differential voltage level across the actuator), the valve needle is caused to engage the valve needle seat, terminating the fuel injection event.

It has now been recognised that if, prior to energising the actuator to initiate a fuel injection event (i.e. while the valve needle is engaged with its seat), the actuator is de-energised relatively slowly, the differential voltage across the actuator can be reduced without substantially increasing the force of engagement (pressure) between the valve needle and its seat. Conveniently, a mechanism for regulating the fuel pressure within the control chamber is provided such that there is not a significant increase in the fuel pressure within the control chamber when the actuator is contracted relatively slowly. Since in an energise to inject injector a reduction in the energisation of the actuator causes the valve needle to move towards the valve needle seat, in accordance with the invention, the initial rate (RT0) at which the differential voltage across the actuator is reduced is suitably predetermined to be lower than a rate that would cause the overstressing of the valve needle and/or the valve needle seat through an increased force of engagement. In this context, therefore, by a "significant increase in fuel pressure" within the control chamber it is meant an increase in pressure resulting in a level of closing force on the valve needle that could cause an undesirably high level of stress (or damage) to either the valve needle or the valve needle seat. It will be appreciated that the valve needle and valve needle seat, will (accordingly to the materials from which they are manufactured) tolerate a certain measurable or known level of stress (from the engagement of the needle with its seat), without unduly limiting the operational life of these parts. Therefore, the control chamber and/or the mechanism (s) by which the fuel pressure within the control chamber is regulated can be arranged/adapted to allow a certain predetermined rate of change (i.e. reduction) of the differential voltage across the actuator when the injector is in its non-injecting state. To assist with such calibrations, comparative data may be measured during injector testing, for example, to calculate the fuel pressure change in a particular control chamber arrangement depending on the rate of change in the differential voltage across a particular piezoelectric actuator.

Suitably, the initial rate (RT0) is lower than the second rate (RT2), such that the actuator can be discharged by a predetermined amount without overstressing the engagement of the valve needle with its seat. However, in some embodiments, as later described, the initial rate (RT0') may be similar to, the same, or even greater than the second rate (RT2). By way of example, under certain engine conditions, such as low fuel pressure, the rate of de-energisation (RT0') of the piezoelectric actuator over a predetermined voltage range (e.g. 0 to 100 V) may not increase the force of engagement between the valve needle and its valve needle seat to an extent that could damage the injector.

Thus, the method of the invention can be employed to decrease the energisation level (or differential voltage level) of a piezoelectric actuator prior to a fuel injection event so that a greater relative increase in the energisation level of the actuator can be used to initiate the fuel injection event. By triggering a larger extension in the actuator, a larger, more rapid fuel injection can be generated.

Advantageously, the pre-injection de-energisation of the actuator can be performed shortly (for example, immediately) before a fuel injection event so that the actuator is only at the lower energisation level for a relatively short period of time. Beneficially, therefore, for the majority of the time between fuel injection events, the actuator will be at a higher energisation level (e.g. differential voltage level $V_{-1}$) than the energisation level (e.g. differential voltage level $V_0$) from which an injection is initiated. In this way, the method of the invention enables an energise to inject injector to be operated to consistently meet high fuel demands in engines, but without having to maintain a consistently low voltage level across the piezoelectric actuator. In particular, an energise to inject injector can thus be operated in a bipolar mode (i.e. between a negative differential voltage when the injector is closed, to a positive differential voltage during an injection event), without having to maintain a negative differential voltage across the actuator between injection events.

It will be understood, of course, that in some circumstances it may be desirable to maintain a slight negative voltage across the piezoelectric actuator between injections, and in other cases it may be desirable to maintain a slight positive voltage across the piezoelectric actuator between injections. In any case, the invention allows the voltage across the actuator between injections to be selected to be any desirable level, according to operating preferences.

In some embodiments of the invention, the differential voltage level to which the actuator is de-energised prior to an injection, i.e. the first differential voltage level ($V_0$), is selected in dependence on at least one engine parameter. Suitably, the engine parameter may be selected from the group consisting of: fuel pressure in the fuel rail (rail pressure, P); the electric pulse time ($T_{on}$; i.e. the length of the fuel injection event); the piezoelectric stack temperature (Temp); the initial differential voltage level ($V_{-1}$) across the stack; engine fuel demand; and intended actuator operating lifespan. Appropriate selection of the first differential voltage level can ensure greater accuracy and repeatability of the control of injection events. In one embodiment, the first differential voltage level ($V_0$) is selected to be in the range −20 V to −50 V. Such a low (i.e. negative) differential voltage level allows a relatively large energisation of the actuator in step (b), which is beneficial where relatively large fuel injections are demanded, such as for a main fuel injection event, and particularly where an engine is operating under high load and/or speed. In other embodiments, the first differential voltage level ($V_0$) may be reduced to a lower level, depending for example on the material and construction of the piezoelectric actuator. Thus, with a "hard" piezoelectric material and/or using increased electrode spacings, it may be possible to reduce the first differential voltage level ($V_0$) to as low as −200 V.

In an advantageous embodiment, the method of the invention further comprises the step of: (d) once the initial fuel injection event has terminated and before a subsequent fuel injection event is initiated, increasing the voltage across the actuator at a third rate (RT3; RT3'), so as to energise the actuator but without initiating an injection event.

In this embodiment, step (d) suitably comprises applying a subsequent charge current ($I_{SUB}$) to the actuator for a subsequent period (T3 to T4; T3' to T4) so as to charge the stack from the third differential voltage level ($V_3$) to a subsequent differential voltage level ($V_4$), wherein the subsequent discharge current ($I_{SUB}$) is not large enough to initiate a fuel injection event.

Following on from the previously described embodiments, it has also been recognised that if, between the initial injection and a subsequent injection, the actuator is energised relatively slowly, (i.e. the voltage across the actuator is increased slowly), an injection does not occur. For similar reasons to that described above, the mechanism by which fuel pressure within the control chamber is regulated may serve to allow a certain (predetermined) rate of extension of the piezoelectric actuator without substantially increasing the fuel pressure within the control chamber and, therefore, without altering the state of engagement of the valve needle with the valve needle seat. The invention advantageously allows the voltage across the actuator to be increased between injections, for example, from a negative differential voltage to a positive differential voltage, but without initiating an injection. Since in an energise to inject injector it may be desirable to operate in a bipolar mode, both for initiating and terminating a fuel injection event, this embodiment can be used to reduce the proportion of time for which the actuator experiences a negative differential voltage and prevent the piezoelectric actuator from depolarising, thus benefiting the life of the actuator and prolonging the service life of the injector.

In an advantageous embodiment, the third rate (RT3) is lower than the first rate (RT1), such that the actuator can be charged and extended by a predetermined amount without causing the valve needle seat to disengage from its seat and thereby initiate a fuel injection event. However, in some embodiments, as later described, the third rate (RT3') may be similar to, the same as, or even greater than the first rate (RT1). In this regard, under certain engine conditions, such as high fuel pressure, a relatively high rate of energisation, RT3', of the piezoelectric actuator (e.g. similar to the rate, RT1) over a predetermined voltage range (e.g. 0 to 100 V) may not be sufficient to initiate a fuel injection event.

In these embodiments, the differential voltage level to which the actuator is energised between injections, i.e. the "subsequent" or fourth differential voltage level ($V_4$) is selected in dependence on at least one engine parameter. Suitably, the engine parameter may be selected from the group consisting of: fuel pressure in the fuel rail (rail pressure, P); the electric pulse time ($T_{on}$; i.e. the length of the fuel injection event); the piezoelectric stack temperature (Temp); the initial differential voltage level ($V_{-1}$) across the stack; engine fuel demand; and intended actuator operating lifespan. As regards the operating lifespan, the subsequent (or fourth) differential voltage level may be selected on the basis of various different criteria. For example, it could be chosen to be a small positive or negative value to minimise the energy consumption of the system. It could be chosen as a small positive value sufficient to maintain polarisation of the actuator. Further, as electrochemical damage increases dramatically with differential voltage (e.g. by the fourth power), it could be chosen as either a small positive or a small negative value to equalise the electrochemical damage caused to the actuator as a result of the comparatively large positive and negative voltage excursions during fuel injector operation, thus minimising the overall electrochemical damage. Accordingly, in some embodiments, the initial differential voltage level ($V_{-1}$) and/or the subsequent differential voltage level ($V_4$) are selected to be in the range +50 V to −20 V, or in the range +10 V to −10 V. In another embodiment, the initial differential voltage level ($V_{-1}$) and/or the subsequent differential voltage level ($V_4$) are approximately 0 V. The person skilled in the art will appreciate that typically, in use, a fuel injector will generate a plurality of fuel injection events within the same and different fuel injection sequence. Hence, the "subsequent" or fourth differential voltage level ($V_4$) associated with an initial (or first) fuel injection event is conveniently the same as the initial differential voltage level ($V_{-1}$) of a subsequent fuel injection event.

A multiple injection "sequence", as used herein, relates to all of the discrete fuel injection events associated with a single main fuel injection. For example, the injections of a particular sequence may include pilot, main and post injections. In some circumstances, a fuel injection sequence includes a main fuel injection event with: optionally one or more (e.g. 2) pilot (or pre-) injections before the main injection, and optionally one or more (e.g. 1) post injections after the main injection.

Thus, in one particular example, the initial fuel injection event is an initial fuel injection event of a first injection sequence and the subsequent fuel injection event is a subsequent fuel injection event of the same injection sequence. Therefore, the initial fuel injection event may be a pilot injection of the first injection sequence and the subsequent injection may be a main injection of the first injection sequence. Alternatively, the initial fuel injection event may be a pilot injection of the first injection sequence and the subsequent injection may be a further pilot injection of the first injection sequence.

In another alternative embodiment, the initial fuel injection event may be a fuel injection event of a first injection sequence and the subsequent fuel injection event may be a fuel injection event of a second injection sequence. For example, the initial injection may be a main injection of a first injection sequence and the subsequent injection may be a main injection of a second, later injection sequence. In this case, the method of the invention may include step (d), in which the differential voltage level across the actuator is increased (at a slow rate that does not initiate a fuel injection event), to a desired level, such as to prolong the operating life of the actuator.

The voltage across the actuator may be increased at the third rate (RT3) as a function of time which has elapsed since the initial fuel injection event. Thus, for a multiple injection sequence, for example, this can be used to ensure that all injections of the sequence (e.g. pilot, main, post) have completed before the actuator is recharged at the third rate. For example, the step of increasing the voltage across the actuator at the third rate (RT3; RT3') may suitable be commenced a predetermined time after the initial injection has terminated.

In another embodiment, the method may be used to increase the voltage across the actuator at the third rate as a function of the voltage across the actuator.

It will be appreciated that in any embodiment the method of the invention may further comprise between steps (b) and (c), the step of: (b') substantially maintaining the second differential voltage level ($V_1$) for a period of time (T1 to T2, the "dwell period"). The dwell period is, therefore, considered to represent the length of time for which the highest level of energisation of the piezoelectric actuator is maintained during a particular fuel injection event. In contrast, $T_{on}$ is considered to represent the total duration of a particular fuel injection event, i.e. it represents the period, T0 to T2.

Suitably, in step (a), the reduction in the voltage across the actuator at the initial rate (RT0; RT0') is controlled actively by an engine control means (ECU). Similarly, in any step of the method, the change in energisation level of the actuator is conveniently controlled actively by an ECU. However, in some circumstances, a passive means of control may be appropriate.

In a second aspect, the invention provides a computer program product comprising at least one computer program software portion which, when executed in an executing environment, is operable to implement any of the methods of the first aspect of the invention.

A third aspect of the invention provides a data storage medium having the or each computer program software portion of the second aspect of the invention stored thereon.

In a fourth aspect the invention relates to a microcomputer provided with the data storage medium of the third aspect of the invention.

In a fifth aspect of the invention, there is provided a fuel injector for use in an internal combustion engine, the fuel injector comprising: an injection control chamber for fuel; a piezoelectric actuator arranged to control fuel pressure within the control chamber via a load transmission arrangement; a valve needle which is engageable with a valve needle seat to control fuel injection through a set of nozzle outlets; a surface associated with the valve needle being exposed to fuel pressure within the injection control chamber such that fuel pressure variations within the control chamber control movement of the valve needle relative to the valve needle seat; and a leakage path for fuel between the control chamber and a source of pressurised fuel; wherein the leakage path is arranged such that, in use, when the differential voltage across the actuator is changed at a predetermined slow rate (RT0; RT0'; RT3; RT3'), the fuel pressure within the control chamber is not changed sufficiently to alter the state of engagement between the valve needle and the associated valve needle seat; whereas when the differential voltage across the actuator is changed at a predetermined higher rate (RT1; RT2), the fuel pressure within the control chamber is changed sufficiently to alter the state of engagement between the valve needle and the associated valve needle seat.

The fuel injector of this aspect of the invention is arranged for use in accordance with any of the methods of the first aspect of the invention. Therefore, fuel pressure within the control chamber determines the state of engagement between the valve needle and the valve needle seat, and changes in fuel pressure within the control chamber control the movement of the valve needle relative to the valve needle seat. Suitably, the fuel injector is an energise to inject injector and is arranged such that an increase in fuel pressure within the control chamber causes the valve needle to lift away from the valve needle seat.

The leakage path for fuel provides a path of fluid communication between the injection control chamber and a source of pressurised fuel (e.g. fuel at injection pressure) such as an accumulator volume. Thus, the leakage path beneficially provides a safety mechanism by which the pressure between the control chamber and a source of pressurised fuel can be equalised in the event of actuator failure during a fuel injection event.

The leakage path suitably comprises a restricted flow passage to prevent the rapid equalisation of fuel pressure between the control chamber and the source of pressurised fuel. Such a restricted flow passage may conveniently be formed in a component of the fuel injector that has a surface exposed to fuel within the control chamber. In one example, the restricted flow passage is formed, at least in part, by a flat on the surface of the valve needle at a point that is exposed to fuel within the control chamber. In another example, the manufacturing clearance between the valve needle and another component of the fuel injector may provide for a suitable restricted flow passage to and from the injection control chamber.

By significantly restricting the free flow of fuel into and out of the control chamber, fuel pressure within the control chamber can be controlled by the energisation level of the actuator via the action of the load transmission arrangement. Advantageously, the leakage path is arranged such that at certain predetermined low rates of change in the energisation level (and length) of the piezoelectric actuator, a sufficient quantity of fuel can flow between the control chamber and the source of pressurised fuel, such that the control chamber does not experience a significant change in fuel pressure. In other words, any slight change in fuel pressure that may be measurable in the control chamber is insufficient to substantially change the position of the valve needle relative to the valve needle seat and, hence, when the valve needle is engaged with the valve needle seat, an injection event is not initiated by a slow increase in the differential voltage across the actuator, and neither is the valve needle or its seat damaged by an increase in the force of engagement by a slow reduction in the differential voltage across the actuator.

By calibrating the leakage path during fuel injector testing, for example, the flow rate of fuel into and out of the control chamber can be measured and adjusted such that desirable predetermined (low) rates of increase and reduction in differential voltage across the piezoelectric actuator are tolerated without causing a significant change in the fuel pressure within the control chamber.

Conveniently, the fuel injector comprises a damping arrangement (or means) for damping movement of the valve needle. By damping movement of the valve needle as it moves away from the valve needle seat into an injecting position, the potential problem of valve needle oscillation can be obviated or mitigated.

In one embodiment, the damping arrangement comprises a damper chamber; the damping arrangement being arranged such that, in use, fuel pressure variations within the damper chamber are damped to a greater extent when the valve needle is caused to disengage the valve needle seat (opening movement of the valve needle), than when the valve needle is caused to engage the valve needle seat (closing movement of the valve needle). Suitably, the damper chamber comprises a spring which serves to bias the valve needle towards the valve needle seat.

In one advantageous embodiment, the load transmission arrangement comprises a sleeve member coupled to the actuator, the sleeve member defining a sleeve bore and the control chamber being defined, at least in part, by a surface associated with the valve needle and by the sleeve bore. In such embodiments, the damping means may comprise a damping orifice provided in the sleeve member, a first end of which fluidly communicates with the damper chamber and a second end of which communicates with a source of pressurised fuel, the damping orifice arranged to damp opening movement of the valve needle from the valve needle seat. Typically, the actuator is arranged within an accumulator volume for receiving fuel at high pressure from the source of pressurised fuel. In one such embodiment, the damping orifice is beneficially in communication with the accumulator volume.

Conveniently, the damper chamber is defined in part by the sleeve bore provided in the sleeve member. It is noted however that the damper chamber and control chamber are not in direct fluid communication with one another.

Suitably, the damper chamber further comprises a vent passage which provides a flow path from the source of pressurised fuel to the damper chamber and the damping means further comprises a valve member operable between a seated position in which it blocks the flow path provided by the vent passage and an unseated position in which the flow path provided by the vent passage is unblocked. The vent passage (s) and valve member provide a means for providing damping during opening of the valve needle, while closure of the valve needle that is beneficially not damped.

As the needle is lifting the damper chamber reduces in volume. The damping orifice, which is a restricted orifice, is the only outlet for fuel within the damper chamber during needle lift. Thus, with the valve member is in its seated position during opening movement of the valve needle, needle opening is therefore damped. During needle closure the damping orifice restricts the rate at which fuel can enter the damper chamber from the pressurised fuel source. This results in a drop in pressure within the damper chamber which, in turn, causes the valve member to lift from its seating. Thus, as the valve member moves to its unseated position during closing movement of the valve needle the vent passages are uncovered. Fuel from the pressurised source is therefore able to enter the damper chamber via the vent passages (in addition to the damping orifice) and consequently, needle closure is substantially undamped.

Conveniently, the valve member may be provided as an annular valve member that is in close communication with the bore of the sleeve member. In its seated position such an annular valve member forms a substantially fluid tight seal between the inside of the sleeve bore and the valve needle. In its unseated position, fluid is able to flow through the vent passage in the sleeve member and through the centre of the annular valve member into the damper chamber (as previously described). Furthermore, the unseating of the valve member during valve needle closure allows the fluid within the damper chamber to be recycled and also provides for substantially undamped valve needle closure.

In some embodiments of the fuel injector of the invention, the valve member is suitably biased towards its seated position. A spring may be provided within the damper chamber to act upon the valve member to bias it into contact with the valve needle and into its seated position. In this manner the valve needle is also biased towards its seating. During needle closure the pressure drop within the damper chamber is sufficient to overcome the action of the spring such that the valve member lifts from the valve needle.

Advantageously, the leakage path also provides a mechanism for auto-closure of the valve needle in the event of faults in the actuator arrangement or associated drive circuit, by providing a system by which the pressure in the control chamber can be equalised with the source of pressurised fuel.

It will be appreciated that the leakage path may be formed in any suitable arrangement. In one example, the leakage path is formed by a clearance between the valve needle and the sleeve bore. However, rather than relying on clearance alone (which can be sensitive to fuel viscosity and leakage is proportional to fuel pressure), the restricted flow passage may suitably be formed, at least in part, by a flat of the surface of the valve needle. Alternatively, the leakage path may be formed as a restricted flow passage in a component of the fuel injector having a surface exposed to fuel within the control chamber. Conveniently, such a restricted flow passage may comprise a bore through the sleeve member of the load transmission arrangement.

The leakage path or restricted flow passage may take any suitable arrangement, for example, in some embodiments the leakage path or restricted flow passage is arranged such that the restriction to fuel flow is greater in one direction than in the other. In one embodiment, the leakage path is arranged such that there is a relatively greater restriction to fuel flow out of the control chamber than into the control chamber. In this way, in use, the fuel flow rate out of the control chamber during an injection is lower than the fuel flow rate into the control chamber at the end of an injection. In one example, the leakage path comprises a restricted flow passage of stepped form. In an alternative example, the leakage path comprises a restricted flow passage having a venturi-type flow restrictor. A venturi-type flow passage (as described in EP 1079095) can conveniently be used to provide directional flow characteristics. Thus, the restricted passage may include a first end region of substantially conical form, a central region that may be cylindrical and a second end region of substantially conical form, wherein the relative cone angles of the first and second end regions determine the directional flow characteristics of the restricted flow passage. For example, if the cone-angle at the end that opens into the control chamber is smaller (e.g. less that 20°) than the cone angle at the end that opens into the source of pressurised fuel (e.g. 40 to 90°), then fuel will tend to flow into the control chamber faster than it will flow out of the control chamber. In a further example, the leakage path may be provided with a valve arrangement to control the fuel flow rate into and/or out of the control chamber.

In another aspect, the invention provides an injection nozzle for use in a fuel injector according to the invention.

In yet another aspect, the invention provides a drive circuit for a fuel injector of the invention, the drive circuit comprising: (A) a first element or elements for applying an initial discharge current ($I_{INI}$; $I_{INI'}$) to the actuator for an initial period (T-2 to T-1) so as to discharge the stack from an initial differential voltage level ($V_{-1}$) across the stack to a first differential voltage level ($V_0$) across the stack; (B) a second element or elements for applying a charge current ($I_{CHARGE}$) to the actuator for a charge period (T0 to T1) so as to charge the stack from the first differential voltage level ($V_0$) across the stack to a second differential voltage level ($V_1$; V2) across the stack; (C) a third element or elements for maintaining the second differential voltage level for period of time (T1 to T2); (D) a fourth element or elements for applying a discharge current ($I_{DISCHARGE}$) to the actuator for a discharge period (T2 to T3) so as to discharge the stack from the second differential voltage level ($V_2$) across the stack to a third differential voltage level ($V_3$) across the stack; (E) a fifth element or elements for applying a subsequent charge current ($I_{SUB}$; $I_{SUB'}$) to the actuator for a subsequent period (T3 to T4; T3' to T4) so as to charge the stack from the third differential voltage level ($V_3$) across the stack to a subsequent (or fourth) differential voltage level ($V_4$) across the stack; and wherein the subsequent discharge current ($I_{SUB}$; $I_{SUB'}$) is not large enough to initiate a fuel injection event.

It will be appreciated that the first, second, third, fourth and fifth element or elements may not necessarily be different elements. Thus, the first and fourth element or elements comprise the same element(s). By way of example, the element or elements may comprise a discharge switch within the drive circuit. Similarly, the second and fifth element or elements comprise the same element or elements, such as a charge switch. Depending on the drive circuit, the third element may comprise a combination of the first, second, fourth and fifth element or elements. For example, the second differential voltage may be maintained at an acceptable level using a combination of a charge switch (e.g. of the second and fifth elements) and a discharge switch (e.g. of the first and fourth elements).

Suitably, the first differential voltage level ($V_0$) and/or the subsequent differential voltage level ($V_4$) are selected in dependence on at least one engine parameter selected from the group consisting of: fuel pressure in the fuel rail (rail pressure, P); the electric pulse time (Ton); the piezoelectric stack temperature (Temp); the initial differential voltage level ($V_{-1}$) across the stack; engine fuel demand; and intended actuator operating lifespan. By selecting the first differential voltage level ($V_0$) having regard to prevailing engine parameters, the voltage to which the piezoelectric actuator is discharged to prior to a fuel injection event can be selected to be an appropriate level in order that the next fuel injection event (s) are appropriate to meet the fuel demand of the engine. For example, when the engine is operating under high loads and/or speeds, $V_0$ may suitably be in the region of −20 to −50 V, so that a large energisation and, hence, a large fuel injection is possible (i.e. the fuel injection is operated in a bipolar mode). However, when, for example, the engine is just ticking over, it is not necessary to operate in a bipolar mode and $V_0$ can be higher, such a in the range 0 to 20 V.

Suitably, the drive circuit of the invention is controlled by an engine control unit (ECU), which can be provided with means for data comparison and/or analysis for determining suitable operating conditions.

The invention also relates to an internal combustion engine having a fuel injector in accordance with the invention therein.

It will be appreciated by the person skilled in the art that any or all relevant features of any one aspect of the invention may be incorporated as equivalent features in any other aspect of the invention, where appropriate.

These and other aspects, objects and the benefits of this invention will become clear and apparent on studying the details of this invention and the appended claims.

BRIEF DESCRIPTION OF THE DRAWINGS

The invention will further be described, by way of example, with reference to the accompanying drawings, in which.

DETAILED DESCRIPTION OF THE INVENTION

Before describing the specific embodiments of the invention as set forth in the figures, the following definitions are provided.

As used herein, it will be understood that by the term "nozzle outlets" it is meant the holes (or apertures) through which fuel is injected from the injection nozzle of the fuel injector and into an associated engine cylinder (in use), which may also be referred to as injection holes, spray holes or similar terms known in the art. By "a set of nozzle outlets" it is meant the one or more nozzle outlets through which fuel is injected when a particular valve needle is disengaged from its associated valve needle seat (or seating region). Thus, in the context of this invention, a valve needle is typically associated with a seating region and an associated "set" of nozzle outlets. It is possible for a valve needle to have more than one associated seating region (e.g. two). In such a case, each seating region is associated with a set of nozzle outlets that may be the same or different. It will be appreciated that a "set" may include only one nozzle outlet. Generally, however, by a "set" it is meant more than one nozzle outlet, for example, between 2 and 12, between 3 and 10, or between 4 and 8, such as 4, 5, 6, 7 or 8.

The term "valve needle" should not be taken to imply a structural limitation in the form of the valve needle. In fact, a valve needle may take any appropriate form, and can be conveniently considered to have a "tip" (or tip region), which is adapted to engage with an associated valve needle seat (or seating region). Typically, a valve needle takes a generally elongate and cylindrical form, such as that of a needle; however, other forms are possible and fall within the term valve needle.

Figure 1:
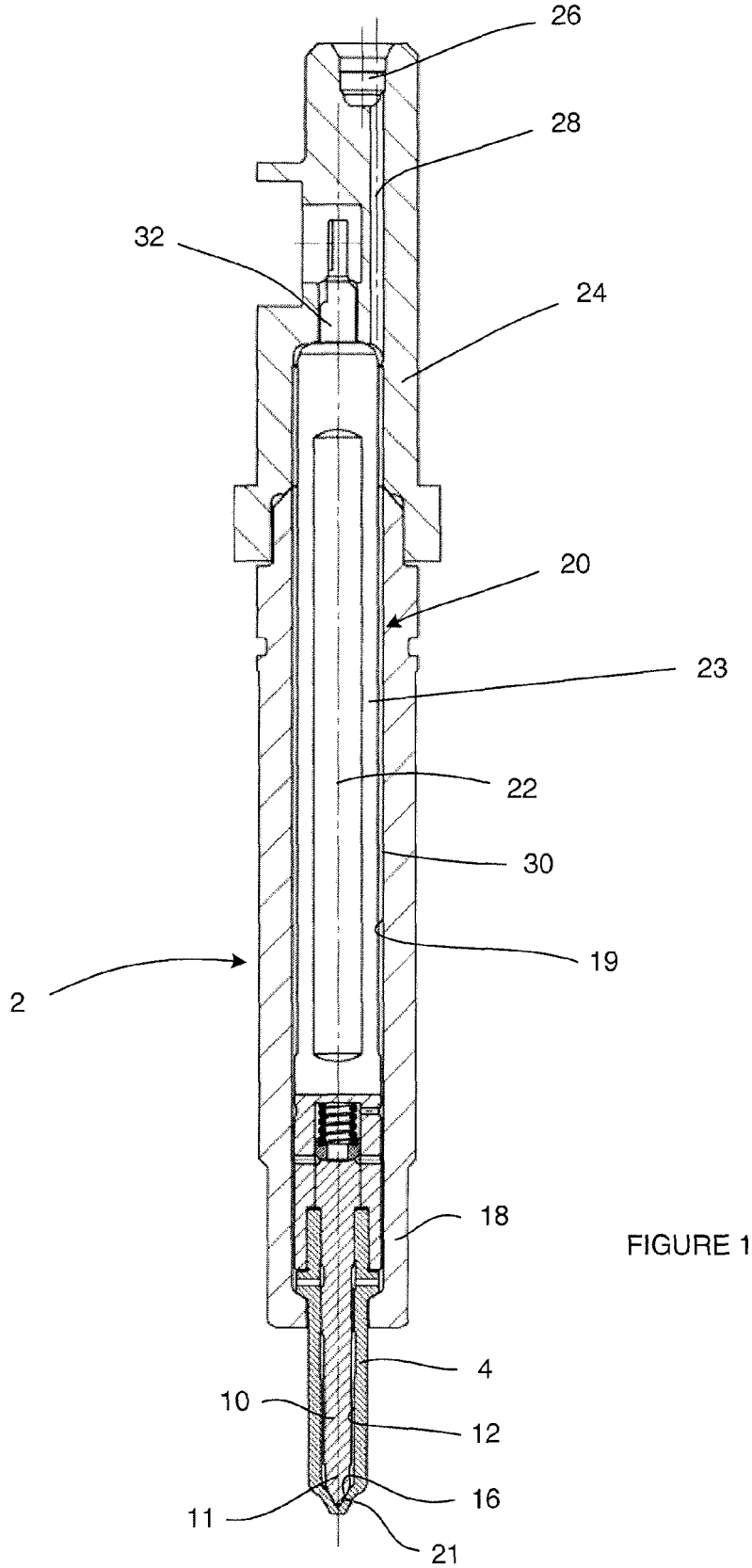
FIG. 1 is a sectional view of an embodiment of the present invention.
Figure 2:
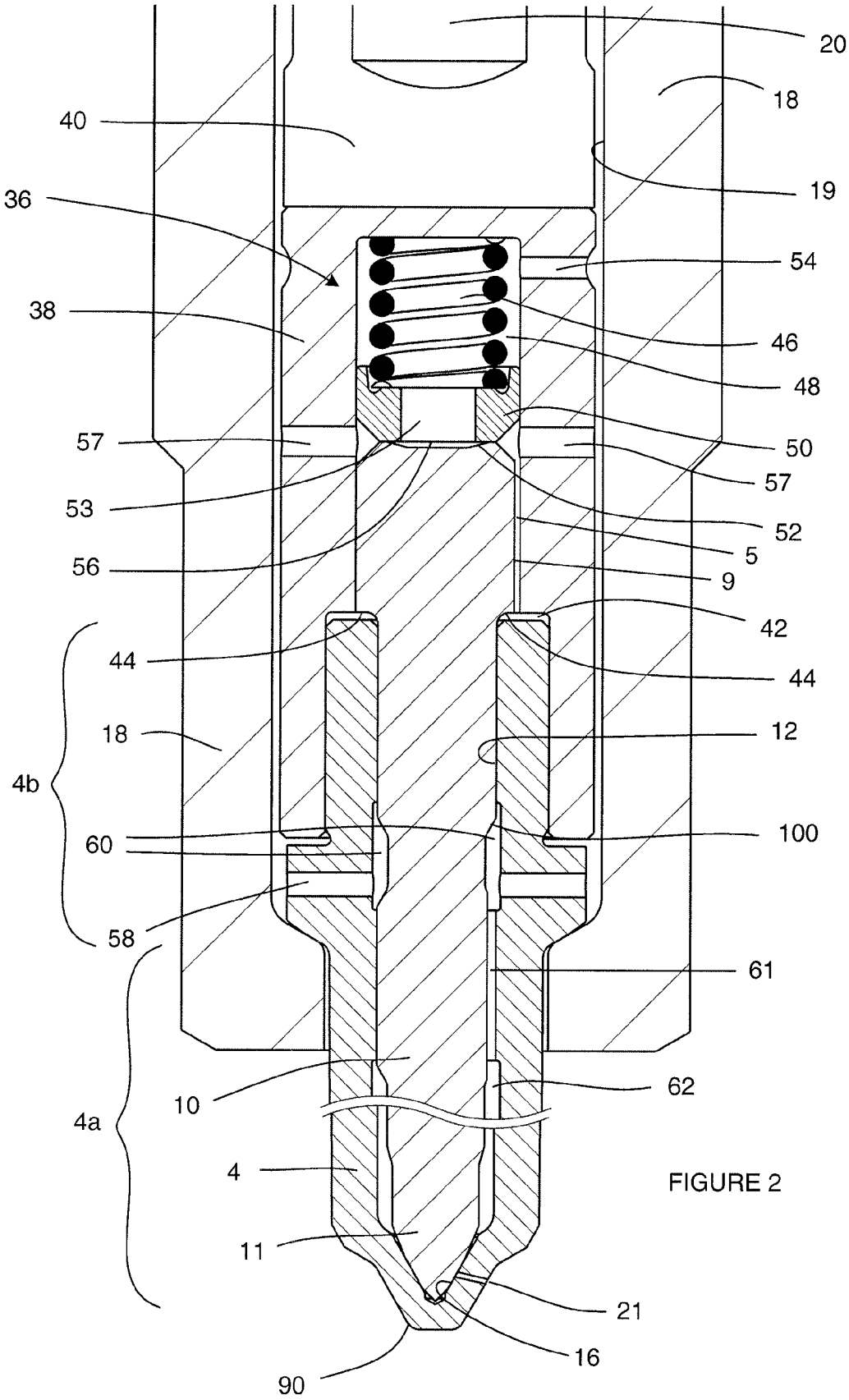
FIG. 2 is an enlarged sectional view of a part of the fuel injector in FIG. 1.

Referring to FIGS. 1 and 2, a fuel injector 2 of the energise to inject type includes a valve needle 10 which is slidable within a bore 12 provided in an injector nozzle body 4. As indicated generally in FIG. 2, the nozzle body 4 has a first region 4*a* of relatively small diameter extending towards the nozzle tip 90 and a second region 4*b* having a relatively large diameter distal to the nozzle tip 90. The valve needle 10 includes a valve needle tip region 11, which is engageable with a valve needle seat 16 defined by the bore 12 to control fuel injection to an associated combustion chamber or engine cylinder (not shown). The injector nozzle body 4 is received, at its upper end (i.e. the second region, 4*b*), within an actuator housing 18 for a piezoelectric actuator 20 including a stack 22 of piezoelectric elements formed from a piezoelectric material. The piezoelectric actuator 20 is operable to control movement of the valve needle 10 between a non-injecting (closed) position, in which it is seated against the valve needle seat 16, and an injecting (open) position in which the valve needle 10 is lifted away from the valve needle seat 16.

The valve needle 10 is shaped to include an upper guide region which forms a sliding fit within the nozzle body bore 12 so as to guide axial movement of the valve needle 10 as it moves relative to the valve needle seat 16.

The lower end (i.e. the first region, 4*a*) of the nozzle body 4 projects from the actuator housing 18 so that injector outlets 21 (only one of which is shown) provided in the nozzle tip 90 can extend, in use, into an engine cylinder (not shown). The upper (or distal) end of the actuator housing 18 is received within an upper housing 24 (shown in FIG. 1) including an inlet 26 for receiving high-pressure fuel from a fuel source (not shown), typically in the form of a common rail. The inlet 26 communicates with a supply passage 28 provided in the upper housing 24. The actuator housing 18 is provided with a through drilling 19, an upper region of which defines an internal volume or "accumulator volume" 30. The supply passage 28 connects with the accumulator volume 30, which is filled with fuel at high pressure. The piezoelectric stack 22 is encapsulated within a sealant coating 23 of a flexible sealant material having an acceptably low permeability to moisture and fuel, and received within the accumulator volume 30 so that the stack 22 is exposed continuously to a large hydraulic force due to fuel pressure within the volume 30. The sealant coating 23 serves to prevent or restrict the ingress of fuel from the accumulator volume 30 into the joints between the individual elements forming the piezoelectric actuator stack, and thus reducing the risk of damage to the actuator stack. Further, as the stack is subject to the compressive load applied by the fuel under pressure, the risk of propagation of cracks is reduced. The piezoelectric stack 22 may be arranged within the fuel injector and coupled to the valve needle 10 is any suitable known manner, for example, as described in EP1555427.

The piezoelectric actuator 20 is also provided with an electrical connector 32 to which a voltage is applied across the stack 22 from an external voltage source (not shown). Being of the energise to inject type, the piezoelectric actuator 20 is configured such that, under non-injecting conditions, a relatively low voltage is applied across the actuator stack 22. With only a relatively low voltage across the stack 22, the stack length is relatively short and the valve needle 10 occupies a position in which it is seated against the valve needle seat 16 so that fuel injection does not take place through the outlets 21. However, when a relatively high voltage is applied across the piezoelectric stack 22, the stack length is caused to increase and, as a result, the valve needle 10 lifts away from the valve needle seat 16 to commence a fuel injection event. Operation of the fuel injector will be described in further detail later.

Turning to FIG. 2, extension and contraction of the stack 22 (in other words, stack movement) is transmitted to the valve needle 10 through a load transmission arrangement 36 (means or mechanism), which is arranged within a lower region of the actuator housing bore 19. The load transmission arrangement 36 takes the form of a motion inverter which converts downward movement (i.e. extension) of the piezoelectric stack 22 into upward movement (opening) of the valve needle 10, and vice versa. The motion inverter includes a sleeve 38, which is received within the lower (or proximal, relative to the injector nozzle) region of the accumulator volume 30.

The piezoelectric stack 22 is associated with an end piece 40, which may form part of the coating or sleeve 23 that encapsulates the stack 22. An upper surface of the sleeve 38 abuts the underside of the end piece 40 so that, as the stack length is varied in use, movement of the stack 22 is transmitted to the sleeve 38. Although the sleeve 38 is shown as a single piece including the upper surface, it will be appreciated that the upper surface of the sleeve could alternatively be provided as a separate member, such as a disc, as described in EP1555427 (see load transmitting member 46).

A control chamber 42 for fuel is defined by a surface of the sleeve 38 and the upper end surface of the nozzle body 4. Fuel pressure within the control chamber 42 acts on a thrust surface 44 of the needle 10 in an upward direction. As depicted, the upper (or distal) end of the valve needle 10 is provided with an axial distally-extending flat surface 9 adjoining the control chamber 42 to form a leakage path 5 extending between the control chamber 42 and a source of pressurised fuel. The flat 9 provides a restricted flow passage for fuel, which is defined between the flat outer surface of the valve needle 10 and the radially inner side of the sleeve 38, in order to allow the flow of fuel into and out of the control chamber 42 from the source of pressurised fuel. It will be appreciated that other than through the leakage path 5, the control chamber 42 is effectively isolated from other sources of fuel. Thus, in this embodiment, the outer surface of the nozzle body 4 defines as small a clearance with the radially inner side of the sleeve 38 as possible, which will still allow a sliding movement of the sleeve 38 over the nozzle body 4. Suitably, therefore, the sliding fit is a sealing fit to substantially prevent the leakage of fuel between the nozzle body 4 and the sleeve 38.

As previously described, however, the leakage path 5 may be provided in any suitable form. Therefore, in another embodiment, the flat 9 may be absent and a leakage path may be provided by clearance between the uppermost (distal) end of the valve needle 10 and the radially inner surface of the sleeve 38. Alternatively, by way of example, a leakage path may be provided by clearance between the upper (distal) end of the nozzle body 4 and the radially inner surface of the sleeve 38: in this case, the clearance may be slightly larger than in the embodiment of FIG. 2.

An upper end of the sleeve 38 axially distal to the valve needle tip 11 is shaped (for example, by way of a blind bore) to define a spring or damper chamber 48, within which a valve needle spring 46 is received. The damper chamber 48 is filled with high-pressure fuel which, together with the valve needle spring force, serves to urge the valve needle 10 into engagement with the valve needle seat 16. The pressure of fuel within the damper chamber 48 also serves to resist opening movement of the valve needle 10.

One end of the valve needle spring 46 abuts the underside of the upper surface of the sleeve 38 and the other end of the spring 46 abuts a damper valve arrangement 50, 52. The damper valve arrangement 36 includes a valve member (or damper valve) 50, in the form of an annular damper valve, located within the spring chamber 48 and engageable with a valve seating 52 defined by an upper surface of the valve needle 10. The annular damper valve 50 provides (in part) an arrangement (or means) for aiding rapid closure of the valve needle 10 at the end of injection, as discussed further below. The damper valve 50 is provided with a central drilling 53, one end of which communicates with the damper chamber 48 and the other end of which communicates with a recessed portion 56 of the upper end of the needle 10.

The sleeve 38 is further provided with a radially extending drilling (or restricted orifice) 54 to provide a fluid communication path between the damper chamber 48 and the accumulator volume 30. As the name suggests, the restricted orifice 54 is of restricted diameter such that it provides a means for damping the opening of the valve needle 10 as described below.

The sleeve 38 is provided with further radially extending drillings 57 (or vent passages). The valve member 50 is subject to fuel pressure variations within the damping chamber 48 such that, in the event that the pressure within the chamber 48 varies sufficiently, the valve member 50 may move from its seating 52 against the action of the spring 46 such that an additional flow path is opened between the damper chamber 48 and the accumulator volume 30 via the vent passages 57. The movement of the valve member 50 and the flow path through the vent passages 57 is described in more detail below.

A fuel delivery means is provided between the accumulator volume 30 and the valve needle tip 11 to enable high-pressure fuel to flow towards the valve needle seat region 16. The fuel delivery means includes an upper pair of radially extending drillings 58 in the nozzle body 4, an annular gallery (or groove) 60 provided towards the upper end of the valve needle 10, and additional flutes (one of which is shown as feature 61 in FIG. 2) provided on the outer surface of the valve needle 10. The outer surface of the valve needle 10 and the nozzle body bore 12 are further shaped to define a fuel delivery chamber 62 between the annular gallery 60 and the valve needle tip 11 in the region of the valve needle seat 16. While the annular gallery 60 is depicted as having been formed by a recess in the valve needle 10, it will be appreciated that in other embodiments the annular gallery may be formed by a recess in the radially inner surface of the nozzle body 4 (within the second region 4*b*) in the region of the radial flow paths 58. In some embodiments, as depicted, the valve needle 10 is shaped so as to define a thrust surface 100 within the annular gallery 80 (for example, in the form of an angled step); the thrust surface 100 being such that fuel within the annular gallery 80 (which is conveniently at injection pressure), applies a force to the valve needle 10 urging it away from its seating region.

From the foregoing description it will be appreciated that the inlet 26, the supply passage 28, the accumulator volume 30, the radial flow paths 58 in the nozzle body 4, the flutes 61 on the valve needle 10 and the fuel delivery chamber 62 together provide a flow path to permit high-pressure fuel that is delivered to the fuel injector 2 at inlet 26 to flow to the valve needle tip 11 in the region of the seat 16.

The fuel injector 2 may be assembled in a known manner. Thus, the actuator housing (or cap nut) 18, nozzle body 4 and other components may suitably be mounted on a upper housing (or nozzle holder) 24 by means of the actuator housing 18, which engages the end of the second region 4*b* of the nozzle body 4 adjacent its interconnection with the first region 4*a* thereof. A seal (not shown), for example, in the form or an resilient ring (e.g. an elastomeric sealing ring) may be located between the actuator housing 18 and the nozzle body 4 to reduce the chance of damage to the actuator housing 18 or nozzle body 4 when the actuator housing 18 is located onto the upper housing 24. The upper housing 24 may, as depicted in FIG. 1, also include a recess within which a portion of the actuator 20 can be housed, if necessary. The actuator housing 18 and upper housing 24 are engaged with each other in any suitable way, such as a screw-threaded portion. In order that all of the components of the fuel injector 2 (or the injector nozzle) correctly align, especially in the radial orientation, when the injector is assembled, pins (not shown) may be provided, the pins being received within suitable recesses provided in an abutting surface of an adjacent component.

The fuel injector 2 is arranged, in use, such that the lower (proximal) portion of the nozzle body 4 that comprises the set of nozzle outlets 21 extends into an associated cylinder of an internal combustion engine (not shown). In this way, fuel from the nozzle outlets 21 is injected directly into the combustion chamber (or space) of the engine cylinder.

A mode of using the fuel injector of FIGS. 1 and 2 will now be illustrated, by way of example, with reference to FIGS. 3 to 9.

Figure 3:
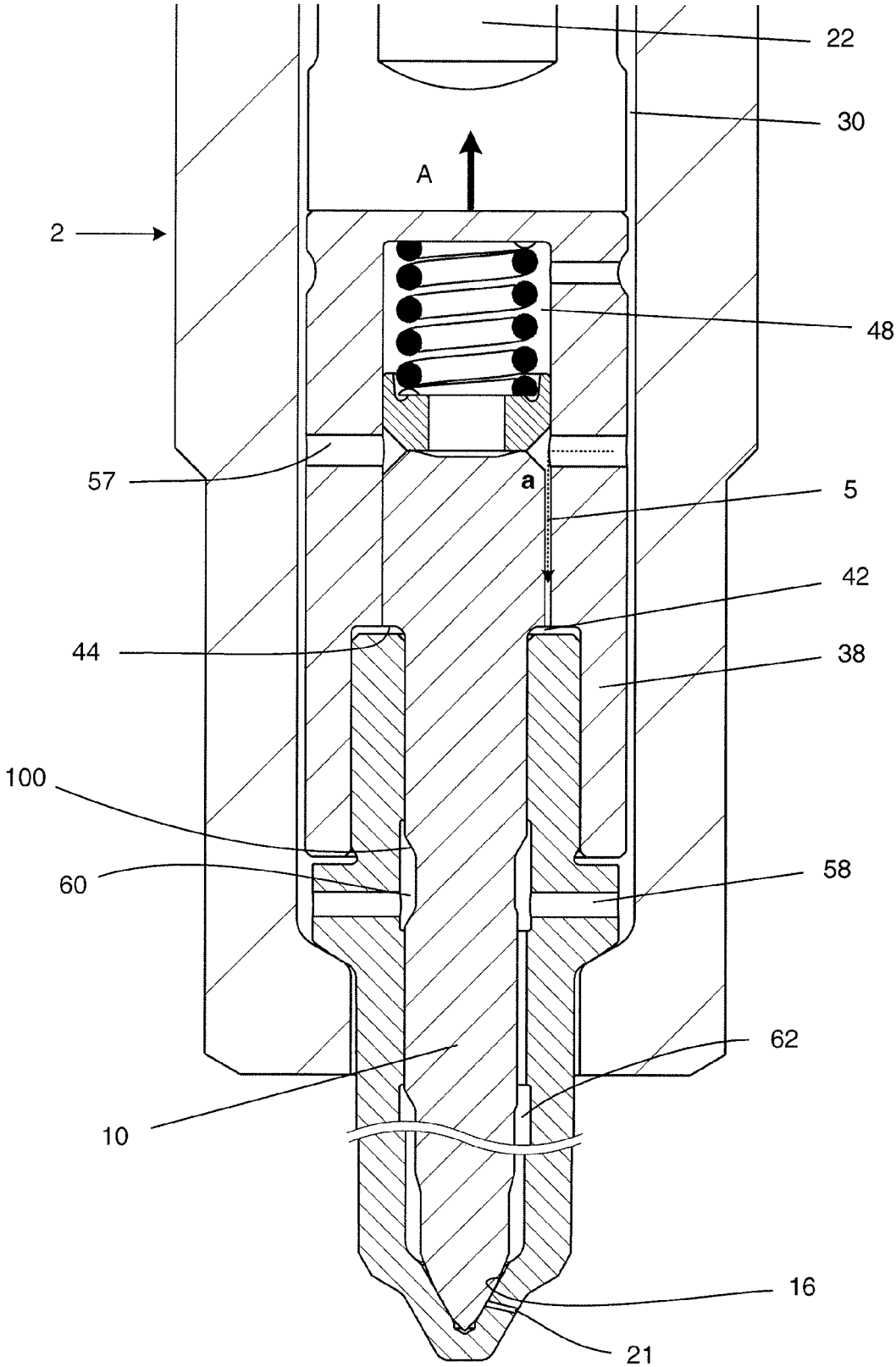
FIG. 3 is a sectional view of the fuel injector of FIGS. 1 and 2 as the injector needle is prepared for a fuel injection event by de-energising the actuator without stressing the injector valve needle or its valve seat.

FIG. 3 shows the injector of FIG. 2 as the injector needle is being prepared for a fuel injection event by de-energising the actuator, but without causing an undesirable increase in the force of engagement between the valve needle 10 and the valve needle seat 16.

Starting from the non-injecting condition shown in FIG. 2, the valve needle 10 is seated against the valve needle seat 16. Fuel is delivered through the delivery path 58, 60, 62 but is unable to flow past the valve needle seat 16 to the injector outlets 21 as the valve needle 10 is seated. In this condition, the differential voltage across the piezoelectric stack 22 is at an initial voltage level ($V_{-1}$) that is relatively low and so the piezoelectric stack 22 has a relatively short length. Typically, the initial voltage level, $V_{-1}$, across the piezoelectric stack 22 is zero volts (0 V), or close to 0 V. In some circumstances, it can be beneficial to select the initial voltage level, $V_{-1}$, to be just greater than 0 V (e.g. between 0 and 10 V). However, in some instances it may be beneficial to select the initial voltage level to be a small negative voltage, such as between 0 and −10 V. With the piezoelectric stack 22 in its contracted state, the force acting on the sleeve 38 is low. Fuel pressure within the control chamber 42 is relatively low and, thus, the upward force acting on the thrust surface 44 due to fuel pressure in the control chamber 42 is also relatively low.

Considering the forces acting on the valve needle 10, the net upward force acting on the valve needle 10 in the opening direction is determined by fuel pressure in the control chamber 42, which acts on the thrust surface 44, and by hydraulic forces acting on the valve needle 10 due to fuel pressure within the delivery path 60, 62 (e.g. via the thrust surface 100). The net downward force acting on the valve needle 10 in the closing direction is determined by fuel pressure within the spring chamber 48 and by the valve needle spring force. It will be appreciated that in this state, the fuel pressure within the accumulator volume 30 is substantially equilibrated with the fuel pressure in the control chamber 42 and in the damper chamber 48, and so any pressure drop along the length of the sleeve 38 and valve needle 10 is minimal, preventing or at least minimising any leakage of fuel between the control chamber 42 and the accumulator volume 30. Thus, when the piezoelectric stack 22 is in its contracted state, fuel pressure within the control chamber 42 is sufficiently low that the net downward force on the valve needle 10 exceeds the net upward force and, thus, the valve needle 10 remains seated against the valve needle seat 16

In order to (further) de-energise the piezoelectric actuator 20 without either causing the valve needle 10 to compress against the valve needle seat 16 or damaging the valve needle seat 16, a negative voltage is applied to the actuator 20 in order to reduce the voltage across the stack 22 at a predetermined initial rate (RT0; RT0'). The de-energisation of the actuator 20 causes it to move upwards at a predictable rate. The contraction of the actuator 20 lifts the sleeve 38 upwards, as indicated by arrow "A", which leads to the expansion of the control chamber 42 and reduces the pressure in the control chamber 42, also at a predictable rate. The reduction in fuel pressure inside the control chamber 42 causes high-pressure fuel from the accumulator volume 30 to be sucked into the control chamber 42 via leakage path 5 and vent passage(s) 57, as indicated by dotted arrow "a". Under these operating conditions, the reduced pressure in the control chamber 42 (coupled with the relative high-pressure fuel and valve needle spring force in damper chamber 48), helps to pull the valve needle 10 downwards and to maintain its engagement with its valve needle seat 16, so no injection is caused. Furthermore, by de-energising the actuator 20 at a predetermined (slow) rate (RT0; RT0'), the net downwards force acting on the valve needle 10 is not increased to an extent that might cause damage to the valve needle 10 or the valve needle seat 16.

On completion of this initial de-energisation step, the piezoelectric actuator is at its selected first differential voltage level ($V_0$), in preparation for a first fuel injection event. In this case, the first differential voltage level ($V_0$) is typically between 0 and −50 V, suitably between −10 and −50 V, and more suitably between −20 and −50 V.

This step of initially de-energising the piezoelectric actuator 20 is particularly suitable for use when a bipolar mode of operation of the fuel injector 2 is desired, because it allows the piezoelectric actuator to be maintained at or close to 0 V for the majority of its operating life (i.e. the time between fuel injection events), but also allows a negative differential voltage to be achieved across the piezoelectric actuator 20 when large fuel injections are required. Therefore, it will be appreciated that in some circumstances, such as when the next fuel injection event is a small fuel injection (e.g. at low engine fuel demand), the initial de-energisation/voltage reduction step described with reference to FIG. 3 may not be necessary. Accordingly, since when an engine is in use, typically, many fuel injection events are carried out as part of a fuel injection sequence or a plurality of sequential fuel injection sequences, some of those individual fuel injection events may not require the initial de-energisation step. Indeed, when the next fuel injection can be carried out without a bipolar mode of operation, it can be advantageous not to carry such an initial de-energisation step.

Figure 4:
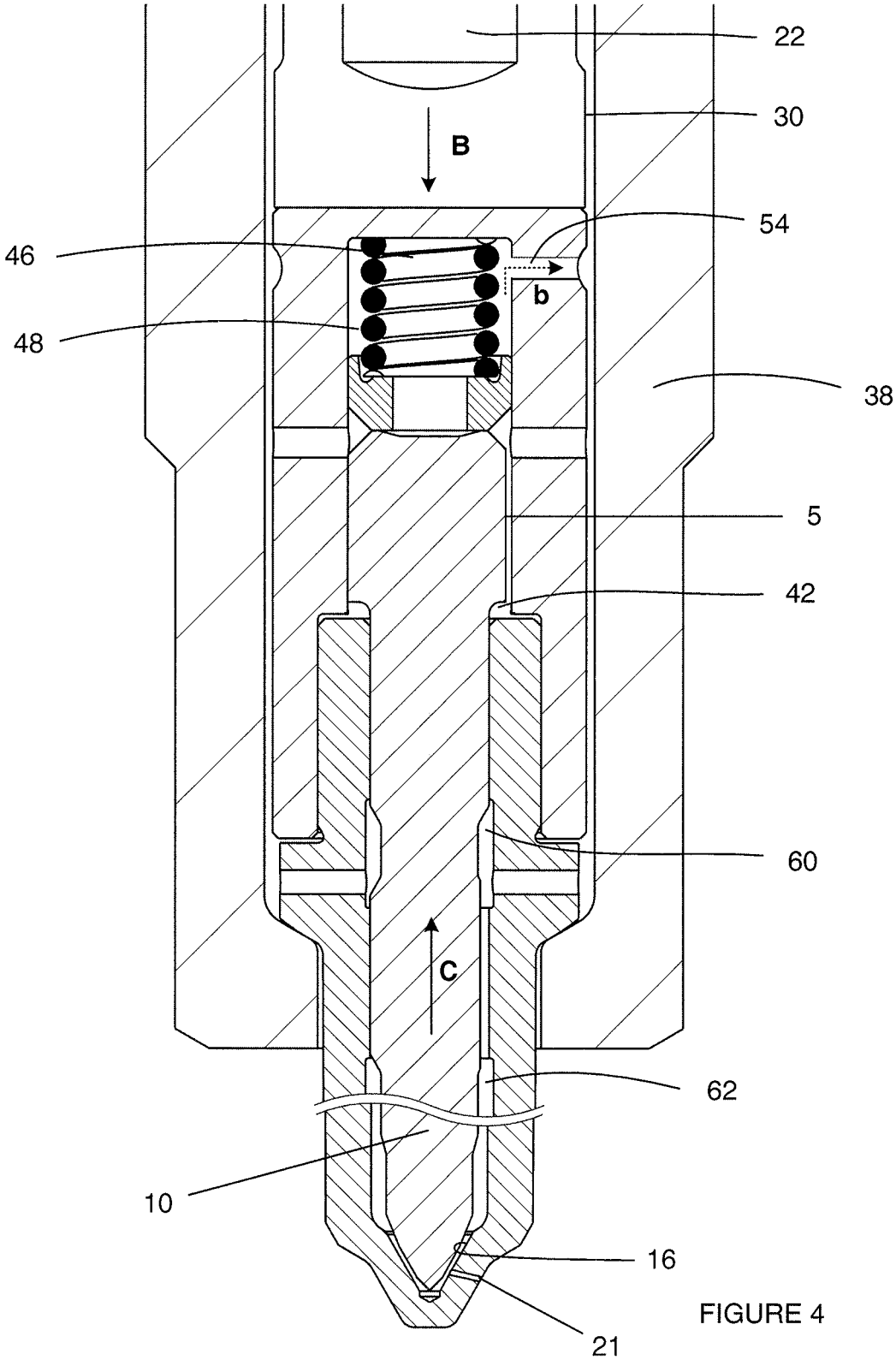
FIG. 4 is a sectional view of the fuel injector of FIGS. 1 to 3 as the injector needle lifts from its seat at the start of a fuel injection event.

Referring to FIG. 4, in order to initiate a fuel injection event, the voltage applied across the piezoelectric stack 22 is increased at a first rate (RT1), to a relatively high differential voltage level, $V_1$ (the "injecting voltage level"). As a result, the length of the piezoelectric stack 22 is increased (beyond that of FIG. 2), causing the end of the stack 22 to move downwards, as indicated by arrow "B". This movement is transmitted to the sleeve 38, which is also caused to move downwardly within the accumulator volume 30, thus reducing the internal volume of the control chamber 42. As a result, fuel pressure within the control chamber 42 is increased.

As fuel pressure within the control chamber 42 increases, a point is reached at which the upwardly directed force acting on the valve needle 10 is sufficient to overcome the force due to fuel pressure within the damper chamber 48 acting in combination with the valve needle spring force. When this condition occurs, the valve needle 10 starts to lift from the valve needle seat 16 as shown by arrow "C" in FIG. 4.

The upward force on the valve needle 10 due to fuel pressure within the delivery path 60, 62 also acts to lift the valve needle 10. As the valve needle 10 starts to lift from the valve needle seat 16, fuel within the delivery chamber 62 is able to flow through the outlets 21, and injection takes place into the engine cylinder.

Furthermore, the combination of the valve needle 10 starting to lift upwards and the sleeve 38 having moved downwards means that the volume of the damper chamber 48 will reduce and, as a result, fuel pressure in the damper chamber 48 increases and fuel will flow through the damping orifice 54 into the accumulator volume 30, as indicated by dotted arrow "b" in FIG. 4. As the damper orifice 54 is of restricted diameter, the flow of fuel through the orifice will be restricted, and the lifting of the needle 10 will be damped by increasing fuel pressure in the damper chamber 48. Damping of opening movement of the valve needle 10 has been found to be advantageous as it avoids unwanted oscillation and overshoot of the valve needle at the desired lift.

Figure 5:
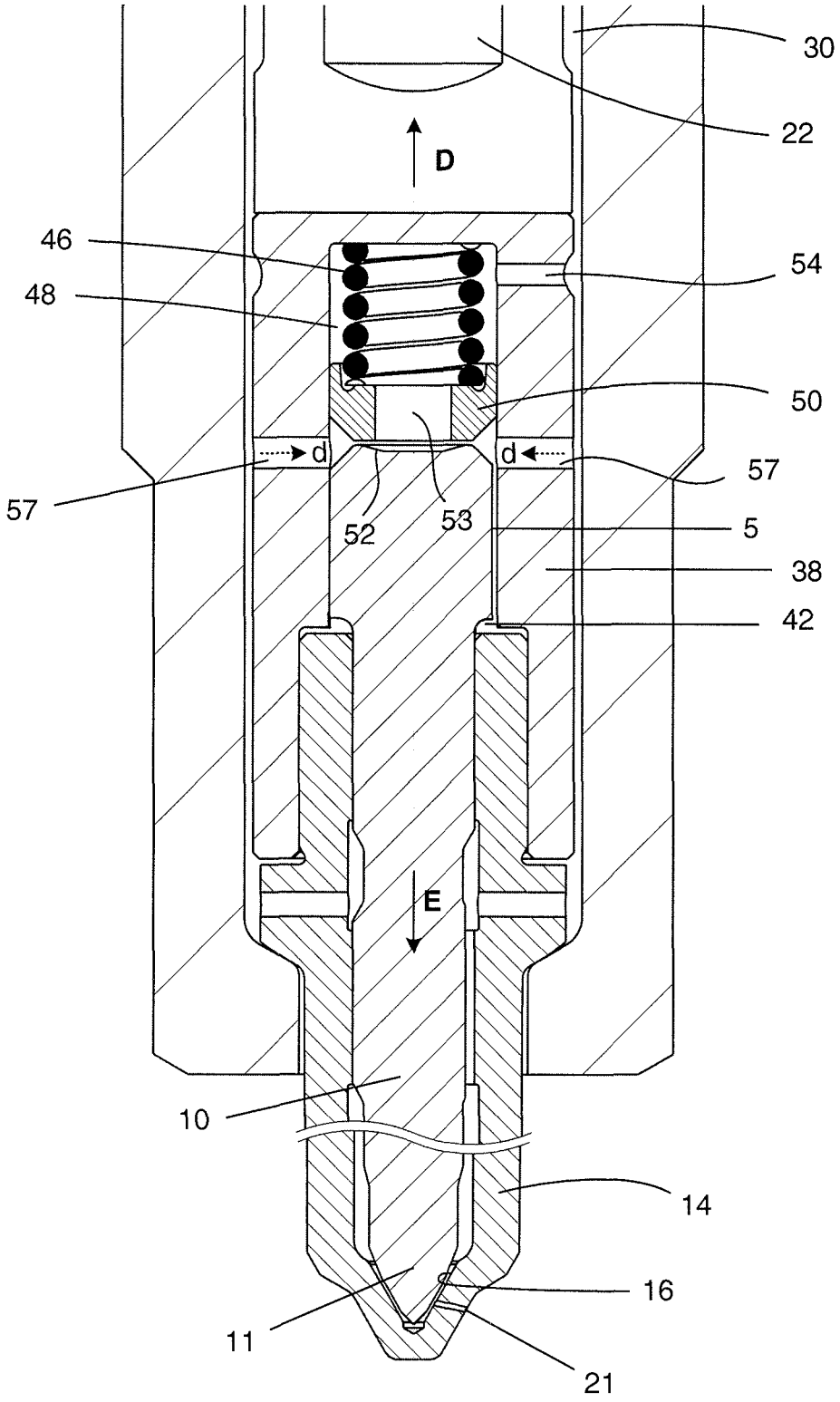
FIG. 5 is a sectional view of the fuel injector of FIGS. 1 to 4 as the injector needle returns to its seat from the raised position shown in FIG. 4 at the end of a fuel injection event.
Figure 6:
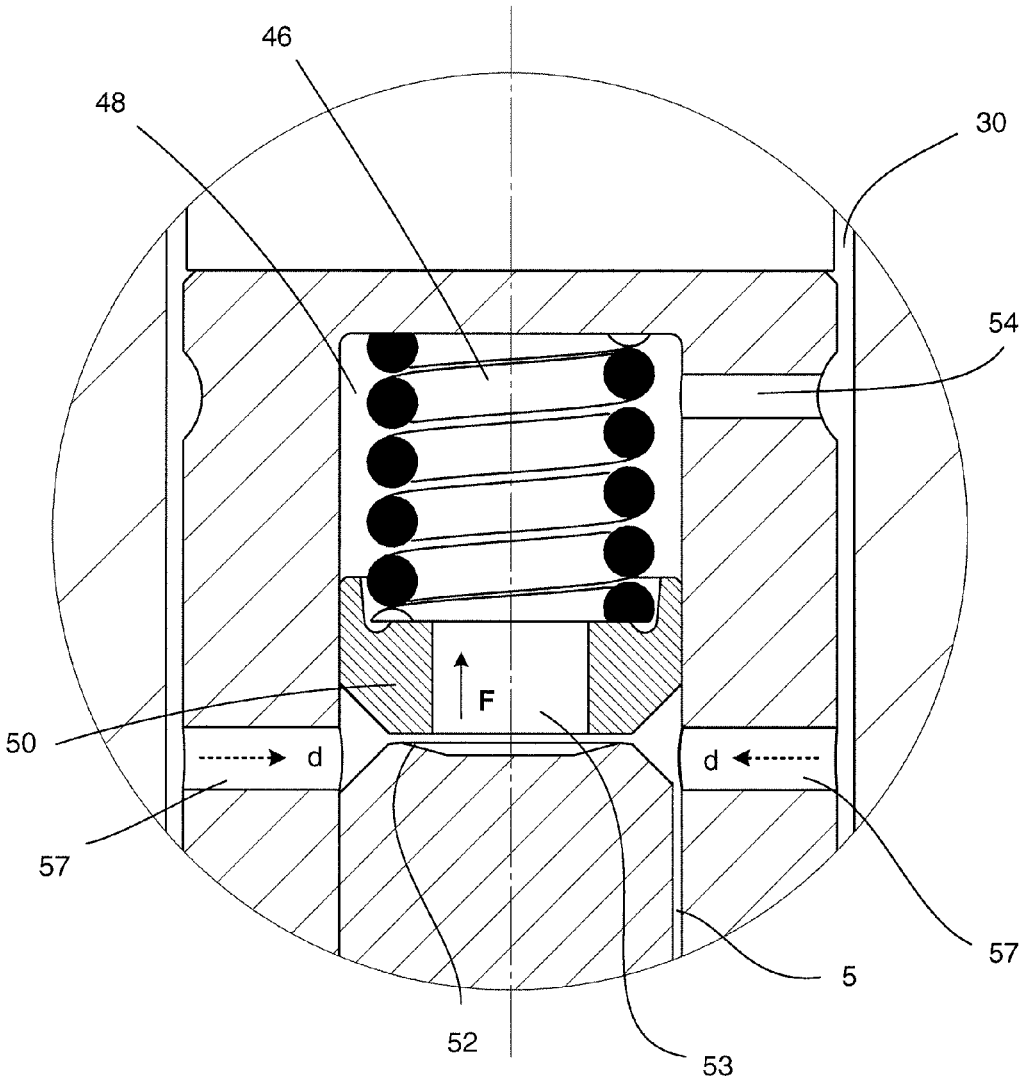
FIG. 6 is an enlarged view of part of FIG. 5.

FIGS. 5 and 6 will be used to demonstrate the closing of the valve needle at the end of a fuel injection event. To terminate an injection, the voltage across the piezoelectric stack 22 is reduced at a second rate (RT2), from the injecting ("second") voltage level ($V_1$; $V_2$) to a third voltage level ($V_3$), thereby reducing the length of the piezoelectric stack 22. The second rate, RT2, is higher than the "initial" rate, RT0 (discussed in regard to FIG. 3), and is sufficient to cause the relatively sharp termination of the injection event as described below. Any suitable differential voltage can be selected as the third voltage level ($V_3$), provided the extent and rate of contraction of the piezoelectric actuator 20 is sufficient to result in the termination of the fuel injection event. For example, the third voltage level ($V_3$) may conveniently be between 10 and −50 V. Suitably, for consistency of operation, the third voltage level ($V_3$) may be chosen to be the same as the first differential voltage level ($V_1$), such as between 0 and −50 V, between −10 and −50 V or between −20 and −50 V. In some embodiments, the third voltage level ($V_3$) is from 0 to −200 V.

As the piezoelectric stack 22 contracts, the sleeve 38 is also pulled upwards, as indicated by arrow "D" in FIG. 5. As a result, the volume of the control chamber 42 increases and, therefore, fuel pressure within the control chamber 42 reduces. A point is reached at which fuel pressure within the control chamber 42 is reduced to a sufficiently low level that the force of the valve needle spring 46, acting in combination with fuel pressure within the damper chamber 48, is sufficient to overcome the opening forces acting on the valve needle 10, and the valve needle 10 is forced downwards until it engages the valve needle seat 16 (see arrow "E"). Injection of fuel through the outlet openings 21 is terminated once the valve needle 10 engages its seat 16.

Whilst damping of opening movement of the valve needle 10 has been found to be advantageous, it is preferable that closing movement of the valve needle 10 is achieved very rapidly. The damping arrangement (48, 50, 52) of this embodiment helps to achieve this purpose. Thus, when the voltage across the piezoelectric stack 22 is decreased to the third voltage level ($V_3$) and the piezoelectric stack 22 starts to contract, the volume of the damper chamber 48 increases. As the damper chamber volume starts to increase, fuel pressure within the damper chamber 48 starts to decrease, and a point is reached at which the annular damper valve 50 is caused to lift away from its damper valve seating 52, as shown in FIG. 5 and more clearly in FIG. 6, which is an expanded view of the damper valve 50 arrangement shown in FIG. 5.

The movement of the damper valve 50 away from its seating 52 (see arrow "F" in FIG. 6) opens an additional flow path for fuel in which fuel from the accumulator volume 30 is able to flow through the vent passages 57 (as indicated by dotted arrows "d"), past the damper valve seating 52, through the central drilling 53 and into the damper chamber 48. Significantly, the rate of fuel flow through the damper valve 50 is relatively fast compared to the flow of fuel through the restricted damping orifice 54, and is in addition to the flow of fuel into the damper chamber 48 through orifice 54. The provision of this additional flow path (i.e. 57, 53) for fuel to enter the damper chamber 48 allows fuel pressure within the damper chamber 48 to increase relatively quickly (compared to the decrease in fuel pressure when opening the injector valve needle 10), which assists closing movement of the valve needle 10 and prevents any significant damping of this movement.

It can be seen that the damper arrangement described in relation to FIGS. 1 to 6 provides a one-way damper valve 50 on top of the valve needle 10, which provides for a high level of damping during needle lifting but which allows needle closure to take place substantially undamped. The damper arrangement beneficially provides for a flow of fresh fuel through the damping chamber 48, which ensures that the fluid used for damping does not heat to such an extent that changing viscosity and bulk modulus characteristics could affect the performance of the fuel injector.

Once a fuel injection event has terminated and before a subsequent fuel injection event is initiated it may—depending on the third differential voltage level ($V_3$) to which the actuator 20 has been de-energised—be advantageous to increase the voltage across the actuator 20 to a more desirable level for maintenance during some, or more suitably, the majority of the time between consecutive injections. For example, when the third voltage level ($V_3$) is a negative voltage (such as between 0 and −50 V), the piezoelectric actuator 20 can become de-polarised over time, which degrades the performance of the actuator. Therefore, if, for performance requirements, the actuator 20 has been de-energised to a negative voltage to terminate a fuel injection event, it can be advantageous to re-energise the actuator between injections to a fourth differential voltage level ($V_4$), for example, approximately 0 V, so as to prevent an undesirable rate of de-polarisation.

In a sequence of fuel injection events, the fourth differential voltage level ($V_4$) associated with a first (or initial) fuel injection event can be considered to be the initial differential voltage level ($V_{-1}$) of the second (or subsequent) fuel injection event.

Figure 7:
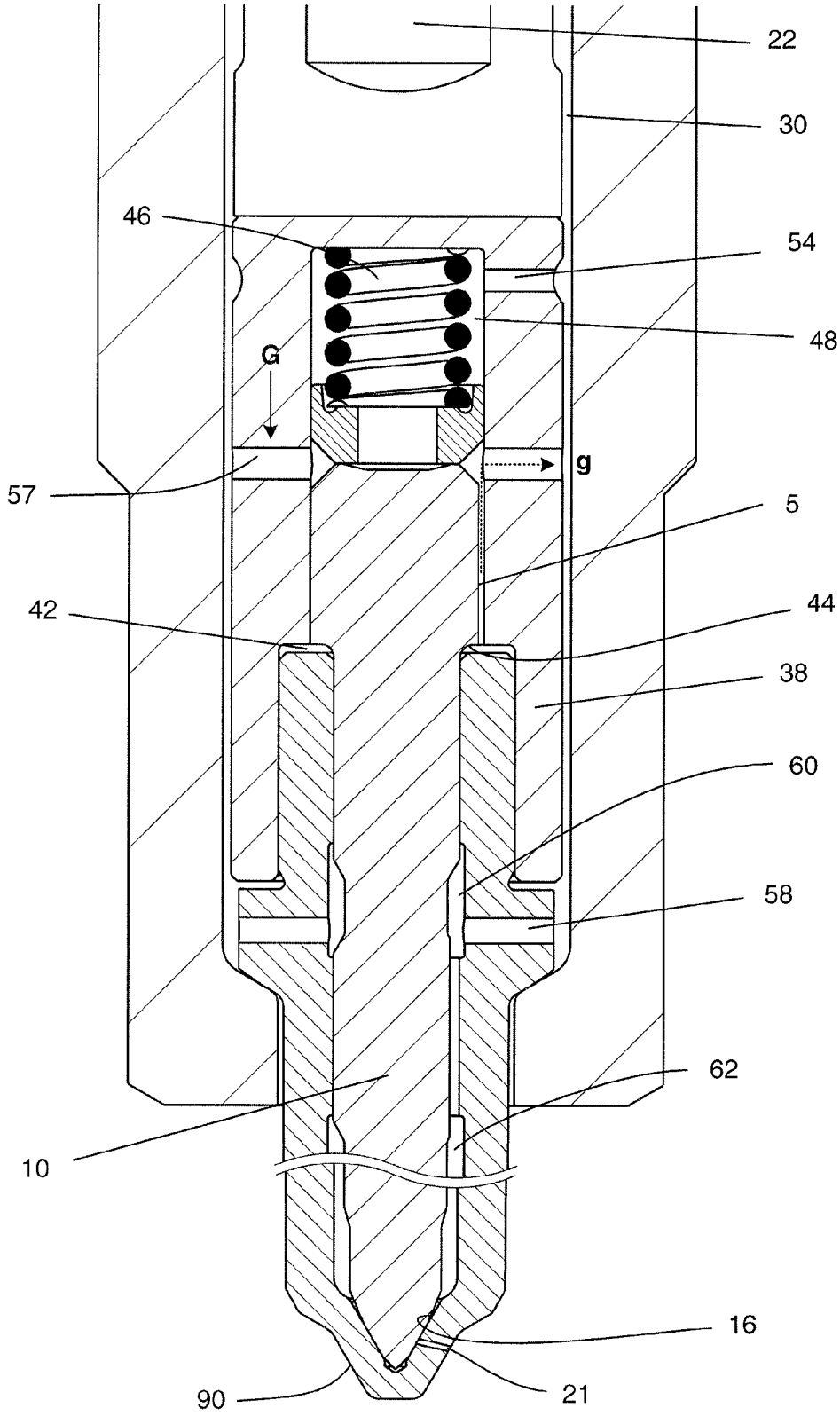
FIG. 7 is a sectional view of the fuel injector of FIGS. 1 to 6 as the actuator is energised between fuel injection events without lifting the valve needle from its seat.

FIG. 7 shows the injector of FIGS. 1 to 6 as the actuator is being energised, but without initiating a fuel injection event.

Starting from the non-injecting condition shown in FIG. 3 (for example, where the third differential voltage level is the same as the first differential voltage level), the valve needle 10 is seated against the valve needle seat 16. Fuel is delivered through the delivery path 58, 60, 62, as before, but is unable to flow past the valve needle seat 16 to the injector outlets 21 as the valve needle 10 is seated. In this condition, the differential voltage across the piezoelectric stack 22 is at a third voltage level ($V_3$; $V_{3'}$) that is relatively low and so the piezoelectric stack 22 has a relatively short length. Typically, the third voltage level across the piezoelectric stack 22 is between 0 and −50 V. With the piezoelectric stack 22 in its contracted state, the force acting on the sleeve 38 is low. Fuel pressure within the control chamber 42 is also relatively low and, hence, the upward force acting on the thrust surface 44 due to fuel pressure in the control chamber 42 is also relatively low.

As in the discussion of FIG. 3, considering the forces acting on the valve needle 10, the net upward force in the opening direction is determined by fuel pressure in the control chamber 42 and by hydraulic forces acting on the valve needle 10 due to fuel pressure within the delivery path 60, 62. The net downward force acting on the valve needle 10 in the closing direction is determined by fuel pressure within the spring chamber 48 and by the valve needle spring force on the damper valve 50. Thus, when the piezoelectric stack 22 is in its contracted state, fuel pressure within the control chamber 42 is sufficiently low that the net downward force on the valve needle 10 exceeds the net upward force and, thus, the valve needle 10 is seated against its valve needle seat 16.

In order to energise the piezoelectric actuator 20 without beginning a fuel injection event, a positive (charging) voltage is applied to the actuator in order to increase the voltage across the actuator at a predetermined third rate (RT3; RT3'). It will be appreciated that this third rate (RT3; RT3') is suitably lower than the first rate (RT1), so that a fuel injection can be avoided, as described below. Although, in some embodiment, the third rate, RT3' may be of similar rate to the first rate, RT1 (as discussed below). The energisation of the actuator 20 causes it to extend so that the end proximal to the injector nozzle tip 90 moves downwards at a predictable rate. The extension of the actuator 20 causes the sleeve 38 to move downward, as indicated by arrow "G" (FIG. 7); leading to a predictable reduction in the volume of the control chamber 42 and an increase in the fuel pressure therein. The increase in fuel pressure inside the control chamber 42 causes fuel from the control chamber 42 to be displaced via leakage path 5 and vent passage(s) 57 into the accumulator volume 30, as indicated by dotted arrow "g". Under the selected operating conditions, the increased pressure in the control chamber 42 and the consequential increased lifting force on the valve needle 10 via the thrust surface 44 is not sufficiently high to overcome the closing force on the valve needle 10 due to the high-pressure fuel and valve needle spring force in damper chamber 48. Therefore, the valve needle 10 does not disengage from the valve needle seat 16 and no fuel injection results.

It will be recognised that the rate of energisation of the actuator 20 is predetermined (for example, during fuel injector testing and/or calibration) so that the resulting fuel pressure changes in the control chamber 42 and damper chamber 48 do not cause the lifting of the valve needle 10, with a consequential fuel injection. Thus, the flow rate of the leakage path 5 can be arranged to allow for a particular rate of piezoelectric actuator 20 energisation (RT3; RT3') without resulting in a fuel injection event. Likewise, the aperture of the damping orifice 54 can also be selected and calibrated to allow for predetermined energisation rates (RT3; RT3').

As previously described, the leakage path 5 or restricted flow passage may be arranged such that the restriction to fuel flow is greater in one direction than in the other. Advantageously, the restriction to fuel flow may be greater out of the control chamber than into the control chamber, so that the fuel flow rate out of the control chamber during an injection is lower than the fuel flow rate into the control chamber at the end of an injection. In this case, the maximum charging rate (RT3; RT3') that can be applied between injections without initiating a fuel injection event may be relatively lower (in terms of absolute numbers), than the initial discharging rate (RT0) that can be achieved between injections without damaging either the valve needle 10 or the valve needle seat 16; although this may depend on the relative differential voltages and the material strength of the valve needle 10 and valve needle seat 16.

On completion of this subsequent energisation step, the piezoelectric actuator is at its selected fourth differential voltage level ($V_4$), which is suitably also the initial differential voltage level ($V_{-1}$), in preparation for a subsequent fuel injection event, according to the above-described method. Thus, in this case, the fourth differential voltage level ($V_4$) is conveniently between −10 and 10 V, suitably between −5 and 5 V, more suitably between −2 and 2 V, and most suitably approximately 0 V.

Figure 8:
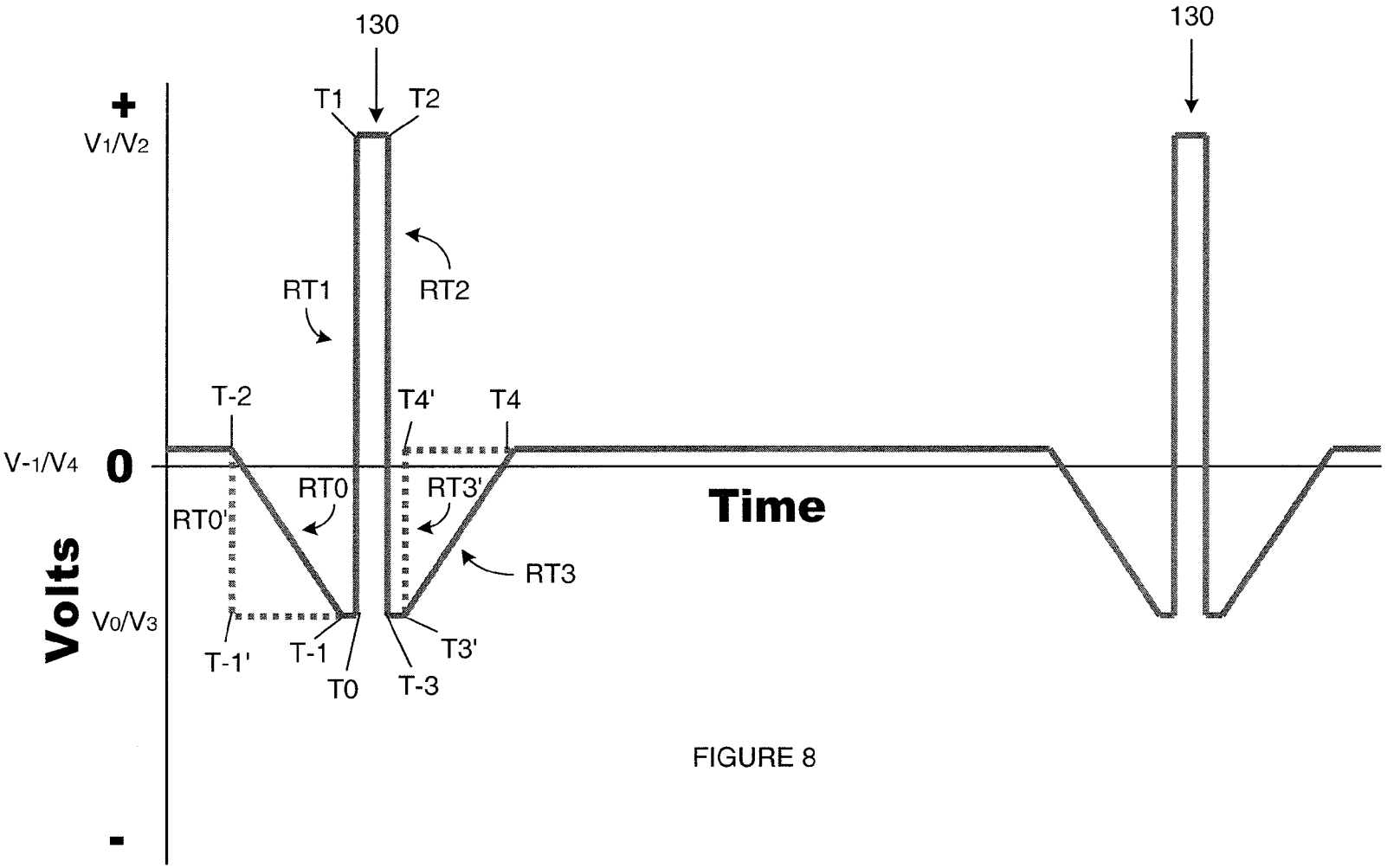
FIG. 8 shows a voltage profile for two fuel injection events/sequences in accordance with embodiments of the invention.

FIG. 8 shows a typical voltage trace for an energise to inject fuel injector 2 over two consecutive fuel injection sequences, each of which comprises a single, main fuel injection event 130. Since, in this example, the injector is an energise to inject type, the trace shown in FIG. 8 could equally be a charge profile representing the charge stored on the piezoelectric actuator 20.

In order to achieve these fuel injections, an ECU is typically employed to control a fuel injector drive circuit (for example, as described in European patent application no. 07250454.1), to carry out the required series of charging (energising) and discharging (de-energising) phases as described below.

Initially, prior to time T-2, the potential difference across the piezoelectric actuator 20 is a small positive voltage, for example, between 0 and 10 V. At this time, therefore, the actuator 20 is relatively uncharged so that the actuator stack is relatively short, the valve needle 10 is engaged with its valve needle seat 16, and no fuel injection is taking place (as depicted in FIG. 2). In these circumstances, the drive circuit for the fuel injector is in a wait state awaiting either an initial de-energisation or an injection (energisation) command signal from the ECU.

Following receipt of a de-energisation command from the ECU at time T-2, a first element or elements of the drive circuit initiates an initial discharge phase so as to cause the piezoelectric actuator 20 to discharge at an initial discharge rate, RT0. During the initial discharge phase, i.e. between T-2 and T-1, an initial discharge current ($I_{INI}$) is applied to the actuator 20 to discharge the stack from its initial differential voltage level ($V_{-1}$) across the stack to a first differential voltage level ($V_0$) across the stack 22. Typically, to regulate the current between T-2 and T-1 the current flowing from the actuator 20 is repeatedly sensed and adjusted to keep it within suitable predetermined limits. A predetermined average discharge current level of $I_{INI}$ (the current set point) is, therefore, maintained at a predetermined rate of RT0, which is not high enough to cause the existing pressure of engagement between the valve needle 10 and its valve needle seat 16 to increase to such an extent that would cause damage to the fuel injector 2.

The average discharge current level ($I_{INI}$) is maintained for a period of time (from T-2 to T-1), which is sufficient to transfer a predetermined amount of charge from the fuel injector, to discharge the actuator 20 from $V_{-1}$ to $V_0$. At time T-1, the first element or elements deactivate, thus terminating the initial discharge current ($I_{INI}$) and preventing the actuator 20 discharging further. During the time period T-2 to T-1 the voltage across the piezoelectric actuator 20 drops from a relatively discharged initial voltage level ($V_{-1}$) of approximately 0 to 10 V, to a more discharged first voltage level ($V_0$) of e.g. −20 to −50 V. This causes the actuator 20 to contract, the control chamber 42 to expand, and the valve needle 10 (which is already engaged with its seat 16), to be pulled towards the valve needle seat 16. However, the rate of contraction of the piezoelectric actuator 20 is predetermined and controlled so as not to cause damage by overstressing of the valve needle 10 against its seat 16.

At time T-1, the drive circuit maintains the piezoelectric actuator 20 at the first discharged voltage level ($V_0$) until the drive circuit determines that it is necessary to initiate the first fuel injection event 130. In other embodiments, the first fuel injection event may be initiated immediately that the first voltage level ($V_0$) is reached.

At time T0, a second element or elements is activated to charge the piezoelectric actuator 20 at a first charge rate, RT1, by applying a charge current ($I_{CHARGE}$) to the piezoelectric stack 22. Thus, during the first charge phase (T0 to T1), the voltage across the actuator is increased from the first differential voltage level ($V_0$) across the stack to a second differential voltage level ($V_1$; $V_2$), so as to initiate a fuel injection.

During the time period T0 to T1 the voltage across the piezoelectric actuator 20 increases from a discharged first voltage level ($V_0$) of e.g. −20 to −50 V, to a charged second differential voltage level ($V_1$). In the example depicted, the first fuel injection event is a main injection and, therefore, the second differential voltage level ($V_1$) may be approximately 200 V. This causes the actuator 20 to extend rapidly, the volume of control chamber 42 to reduce, pressurising the fuel within the control chamber 42, and the valve needle 10 to lift off its seat 16. The rate of charging of the piezoelectric actuator 20 (RT1) is predetermined to be rapid enough to cause the opening of the fuel injector 2.

At T1, a third element (or elements) of the drive circuit is used to maintain the piezoelectric actuator 20 at the charged voltage level ($V_1$; V2, e.g. 200 V) for a predetermined dwell period, T1 to T2, during which the injector valve needle 10 is held open to perform the injection. The period of time for which the valve needle is held open is controlled to ensure that the required quantity of fuel is injected into the associated combustion cylinder.

At the end of the dwell period (i.e. at T2) a fourth element or elements of the drive circuit is activated to discharge the piezoelectric actuator 20, thereby reducing the differential voltage across the stack 22 at a rate RT2, to terminate the fuel injection event 130. Between T2 and T3, a discharge current ($I_{DISCHARGE}$) is applied to the actuator 20 to discharge the stack 22 from the second differential voltage level ($V_2$) to a third differential voltage level ($V_3$). When the predetermined (discharged) third differential voltage level ($V_3$) is reached at time T3 the valve needle 10 is re-engaged with its valve needle seat 16 and fuel is prevented from exiting from the nozzle outlets 21. As depicted, the third differential voltage level ($V_3$) may conveniently be set to the same level as the first differential voltage level ($V_0$).

Since in this example, a main fuel injection event 130 has how been terminated, the ECU may determine that there is a sufficient period of time before the next injection, that it will be beneficial and convenient to recharge the piezoelectric actuator 20 between injections without initiating a subsequent fuel injection event. For example, the method of the invention may thus comprise increasing the voltage across the piezoelectric actuator 20 at a third rate RT3 (insufficient to initiate a fuel injection event) a predetermined time period (T3 to T3'), after the initial fuel injection event 130 has terminated.

Therefore, immediately at the end of the main fuel injection event 130 (i.e. at T3) or, as depicted in FIG. 8, at a predetermined time point after an injection event (T3') a fifth element (or elements) of a drive circuit may be activated to increase the voltage across the actuator 20 at a third rate (RT3), which is lower than the first rate (RT1), so as to energise the actuator 20 but without initiating an injection event. Thus, during the period T3' to T4, a subsequent charge current ($I_{SUB}$) is applied to the actuator 20 to charge the piezoelectric stack 22 from the third differential voltage level, $V_3$ (which, as depicted, may be the same as $V_0$), to a subsequent differential voltage level, $V_4$. Typically, for convenience and consistency of fuel injections, the subsequent differential voltage level, $V_4$ is selected to be the same as the initial differential voltage level $V_{-1}$ (i.e. approximately 0 to 10 V). However, depending on operating parameters, the level of $V_4$ may be changed to compensate for any electrochemical damage to the piezoelectric actuator 20 during its previous operating conditions, for example.

At this stage, the subsequent charge current ($I_{SUB}$) is predetermined such that it is not large enough to initiate a fuel injection event. This is possible because, as previously described in relation to FIG. 7, if the actuator 20 is caused to extend relatively slowly (by charging at a relatively low rate), it does not cause any corresponding movement of the injector valve needle 10, due to the arrangement of the hydraulic coupling between the actuator 20 and the valve needle 10.

Prior to a subsequent (or "second") injection being demanded by the ECU, the low differential voltage $V_0$ is re-established across the piezoelectric actuator 20 (as illustrated in FIG. 8), in the same or similar manner to that already described for the initial discharge period, T-2 to T-1. Typically, this initial discharge process will occur a few milliseconds prior to the subsequent injection.

Once the low voltage level, $V_0$, is re-established across the actuator 20, the injector 2 is ready to perform another injection when demanded by the ECU. However, the benefit of having re-charged the actuator 20 slowly at the end of the previous injection is that the actuator 20 of the injector 2 experiences a negative (or other non-optimal) differential voltage level across it for a much reduced period of time in comparison to conventional operating methods, whereby: an energise to inject injector may remain discharged to a negative differential voltage level between injections; or alternatively, the benefits of bipolar operation are not available. The method of the present invention therefore increases the service life of the actuator 20 and, therefore, increases the service life of the injector 2.

FIG. 8 also depicts an alternative embodiment of the method of the invention (see dotted trace), in which it is not necessary to discharge the piezoelectric actuator 20 slowly from the initial voltage level ($V_{-1}$) to the first voltage level ($V_0$) prior to an injection 130; and it is not necessary to charge the piezoelectric actuator 20 slowly between the third voltage level ($V_3$) and the subsequent (or fourth) voltage level ($V_4$) after the fuel injection event 130.

In this regard, it will be appreciated that where the differential voltage change required between injections is not large; i.e. it is not large enough to result in the overstressing of the fuel injector components, or causing a fuel injection event (e.g. less than approximately 20 V), it may not be necessary to change voltage relatively slowly. In such cases, the initial discharging rate (RT0') may be similar to the second discharging rate (RT1) for terminating a fuel injection event, and the third charging rate (RT3') may be similar to the first charging rate (RT1) for initiating a fuel injection event, as described below.

In this alternative embodiment, it has been predetermined (for example, by an ECU), that the differential voltage drop, $V_{-1}$ to $V_0$ is not large enough that the valve needle 10 or the valve needle seat 16 will be damage by overstressing, even when the rate of discharge of the piezoelectric actuator 20 (RT0') is relatively fast.

Therefore, following receipt of a de-energisation command from the ECU at time T-2, the piezoelectric actuator 20 is discharged at a faster initial discharge rate, RT0'. During this initial discharge phase, an initial discharge current ($I_{INI'}$) is applied to the actuator 20 between T-2 and T-1' to discharge the stack from its initial differential voltage level ($V_{-1}$) to the first differential voltage level ($V_0$). However, in this case, it has been determined that the average discharge current level of $I_{INI}'$ can be maintained at a higher rate RT0', because the voltage drop is not sufficient to cause the existing pressure of engagement between the valve needle 10 and its valve needle seat 16 to increase to such an extent that would cause damage to the fuel injector 2.

The maximum differential voltage drop across the actuator 20 that can be carried out at a relatively high rate (RT0') can, for example, be determined during fuel injector 2 testing and calibration. In this regard, the allowable differential voltage drop ($V_{-1}$ to $V_0$) may depend on engine parameters, such as fuel pressure (P), e.g. the pressure of fuel in the accumulator volume 30. For instance, at high fuel pressures there is already a relatively high interaction force (stress) between the valve needle 10 and its seat 16 and, therefore, a rapid voltage drop may be undesirable as it could lead to injector 2 damage. In contrast, at low fuel pressures, it may be possible to rapidly discharge the piezoelectric actuator 20 by up to approximately 100 V without over stressing either the valve needle 10 or its seat 16.

Similarly, after the fuel injection event 130, it has been predetermined (for example, by an ECU), that the differential voltage increase, $V_3$ to $V_4$ between injections is not large enough that an unwanted fuel injection event will be initiated, even when the rate of energisation of the piezoelectric actuator 20 (RT3') is relatively fast.

Therefore, following receipt of an energisation command from the ECU at time T3', the piezoelectric actuator 20 is charged at a faster third rate, RT3'. During this charging phase (T3' to T4'), a subsequent charge current ($I_{SUB'}$) is applied to the actuator 20 to discharge the stack from its third differential voltage level ($V_3$) to the subsequent (or fourth) differential voltage level ($V_4$). It has been determined that the average charge current level of $I_{SUB'}$ can be maintained at a higher rate RT3', because the voltage increase is not sufficient to initiate a fuel injection even when the actuator 20 is charged at a relatively fast rate.

As before, the maximum differential voltage gain across the actuator 20 that can be carried out at the relatively high rate (RT3') can be determined during fuel injector 2 testing and calibration. As described above in relation to the rapid discharging of the actuator 20, the differential voltage change that can be carried out at a relatively high rate without initiating an injection event may depend on engine parameters, such as fuel pressure. For example, at high fuel pressures it may be possible to charge the actuator 20 by up to 100 V or more, without initiating a fuel injection event. However, at low fuel pressures, a rapid differential voltage increase of only 20 V can be sufficient to cause an injection.

It will be appreciated that, in alternative embodiments, one or other of the initial discharge phase (T-2 to T-1') and the subsequent charge phase (T3' to T4') may be carried out rapidly, as depicted in the alternative embodiment of FIG. 8; while the other of the initial discharge phase (T-2 to T-1) and the subsequent charge phase (T3' to T4) may be carried out at the previously described lower rate, as desired. Whether a faster or slower initial discharge or subsequent charge phase is carried out may, for example, be determined according to the magnitude of the desired differential voltage change (which may be different before the first injection compared to that between injections), and/or the fuel flow characteristics of the leakage path 5.

Figure 9:
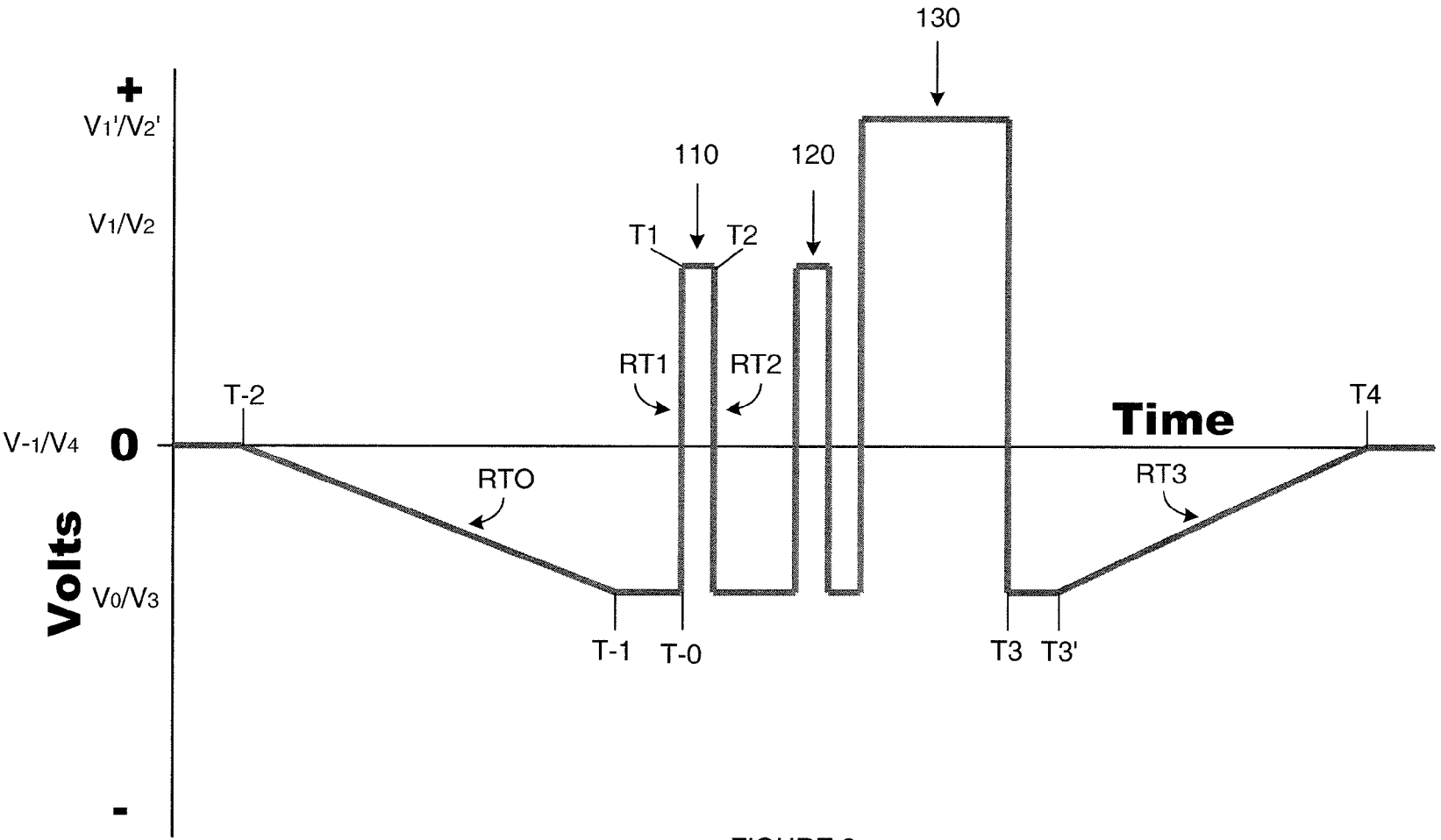
FIG. 9 is a voltage profile for a fuel injection sequence in accordance with another embodiment of the invention.

Turning to FIG. 9, this shows a typical voltage trace for an energise to inject fuel injector 2 during an injection sequence comprising a main fuel injection event 130, which is preceded by two pilot (or pre-) injections, 110 and 120. Again, since the injector of this example is an energise to inject type, the trace shown in FIG. 9 could equally be a charge trace.

Initially, prior to time T-2, the potential difference across the piezoelectric actuator 20 is at approximately 0 V. At this time, therefore, the actuator 20 is relatively uncharged, so that the actuator stack is relatively short, the valve needle 10 is engaged with its valve needle seat 16 and no fuel injection is taking place (as depicted in FIG. 2. In these circumstances, the drive circuit for the fuel injector 2 is in a wait state awaiting either an initial de-energisation or an injection command signal from the ECU.

At time T-2, an initial discharge phase is initiated to cause the piezoelectric actuator 20 to discharge at an initial discharge rate, RT0, as described in relation to the first embodiment of FIG. 8.

At time T-1, the initial discharge phase is terminated to prevent the fuel injector 2 discharging further. During the time period T-2 to T-1 the voltage across the piezoelectric actuator 20 drops from a relatively discharged initial voltage level ($V_{-1}$) of approximately 0 V, to a more discharged first voltage level ($V_0$) of e.g. −20 to −50 V. Since the first fuel injection event 110 is a pilot injection, it some embodiments the first differential voltage level ($V_0$) may not be as low as when the first fuel injection event is a main injection 130, such as in FIG. 8.

At time T-1, the drive circuit maintains the piezoelectric actuator 20 at the first discharged voltage level ($V_0$) until the drive circuit determines that it is necessary to initiate the first fuel injection event 110.

At time T0, the voltage across the piezoelectric actuator 20 is increased at a first charge rate, RT1, by applying a charge current ($I_{CHARGE}$) to the actuator. Thus, during the first charge phase (T0 to T1), the voltage across the actuator is increased from the first differential voltage level ($V_0$) across the stack to a second differential voltage level ($V_1$; $V_2$), so as to initiate a pilot fuel injection 110.

As the first fuel injection event 110 is a pilot injection, the second differential voltage level ($V_1$) may, for example, be between 50 to 100 V.

The second differential voltage level ($V_1$) is maintained for a predetermined dwell period, T1 to T2, during which the injector valve needle 10 is held open to perform the pilot injection 110. As before, the period of time for which the valve needle is held open is controlled to ensure that the required quantity of fuel is injected into the associated combustion cylinder.

At the end of the dwell period, the voltage across the piezoelectric actuator 20 is reduced at a rate RT2 to terminate the fuel injection event 110. When the predetermined discharged third differential voltage level ($V_3$) is reached at time T3 the valve needle 10 is re-engaged with its valve needle seat 16 and the fuel injection event 110 is terminated. As depicted, the third differential voltage level ($V_3$) may conveniently be set to the same level as the first differential voltage level ($V_0$).

Since the first fuel injection event 110 is a pilot injection there may be a relatively short period of time between the end of first fuel injection event 110 and the start of the subsequent, second fuel injection event 120. In such circumstances, the ECU may determine that it is not necessary (or possible) to recharge the piezoelectric actuator 20 between injections (without initiating a fuel injection event). For example, the method of the invention may thus comprise increasing the voltage across the piezoelectric actuator 20 at a third rate RT3 (insufficient to initiate a fuel injection event) a predetermined time period, T3 to T3', after the initial fuel injection event 110 has terminated.

As depicted in FIG. 9, therefore, a second pilot fuel injection event 120 and a main fuel injection event 130 may be initiated, maintained and terminated in a similar manner to that described in relation to the first fuel injection event 110. It will be noted, however, that for a main injection event the piezoelectric actuator 20 may be charged to a higher second differential voltage level ($V_{1'}$) of e.g. 200 V.

For each fuel injection event (110; 120; 130), the timing of the respective charge phase may be read from a timing map that relates charge phase time against fuel delivery volume, to ensure that the correct amount of fuel is injected in each event. As for the previously described discharge phase (T-2 to T-1), during the charging phase the current flowing into the piezoelectric actuator 20 is repeatedly monitored and adjusted (as necessary) to ensure that it is kept within predetermined limits for a period of time that is sufficient to transfer a predetermined amount of charge onto the piezoelectric actuator 20, to open the fuel injector by the desired amount.

At the end of the main fuel injection event (T3) or, as depicted, at a predetermined time point after an injection event, T3', the voltage across the actuator 20 is increased at a third rate (RT3), which is lower than the first rate (RT1), so as to energise the actuator 20 but without initiating an injection event. Thus, during the period T3' to T4, a subsequent charge current ($I_{SUB}$) is applied to the actuator 20 to charge the piezoelectric stack 22 from the third differential voltage level, $V_3$ (which, as depicted, may be the same as $V_0$), to a subsequent differential voltage level, $V_4$. As previously described, the subsequent discharge current ($I_{SUB}$) is predetermined such that it is not large enough to initiate a fuel injection event.

Prior to a further (or "first") injection being demanded by the ECU, the low differential voltage $V_0$ may be re-established across the piezoelectric actuator 20 (not illustrated in FIG. 9).

In any of the aforementioned embodiments, the advantage is achieved that voltage across the actuator of an injector is adjusted to approximately 0 V when it is not injecting so that, overall, the injector spends a considerably reduced amount of time at a positive or negative differential voltage level, therefore, prolonging its service life.

While some advantages of the invention will be readily apparent from the above description, other benefits of the invention should be noted.

As the person skilled in the art will appreciate, an engine generally comprises a plurality of fuel injectors. Therefore, the aforementioned methods may be applied to any of the injectors of the engine. Likewise, the invention encompasses engines comprising one or more fuel injectors or injection nozzles of the invention.

In alternative implementations, the rates of the initial discharge phase (RT0; RT0') and the subsequent charge phase (RT3; RT3') may be determined according to the voltage across the injector.

It will be appreciated that the various steps of the methods of the invention recited hereinbefore and in the claims need not, in all cases, be performed in the order in which they are introduced, but may be reversed or re-ordered whilst still providing the advantageous associated with the invention.

Although particular embodiments of the invention have been disclosed herein in detail, this has been done by way of example and for the purposes of illustration only. The aforementioned embodiments are not intended to be limiting with respect to the scope of the appended claims, which follow. For example, the choice of actuator for use in a fuel injector of the invention, the exact mechanism for the direct coupling between the actuator 20 and the valve needle 10 (such as the form of the sleeve 38), and the arrangement of nozzle outlets 21 may be decided on a case by case basis, and such variations are encompassed within the scope of the invention. Thus, it is contemplated that various substitutions, alterations, and modifications may be made to the various components of the fuel injectors and injection nozzles without departing from the spirit and scope of the invention as defined by the claims.

The invention claimed is:

1. A method of operating a fuel injector having a piezoelectric actuator for controlling movement of an injector valve needle, the method comprising:

(a) prior to an initial fuel injection event, reducing the voltage across the actuator from an initial differential voltage level, in which state the fuel injector is in a non injecting condition, to a first differential voltage level, in which state the fuel injector is in a non injecting condition, at an initial rate so as to de-energise the actuator;

(b) increasing the voltage across the actuator from the first differential voltage level at a first rate in order to initiate an initial fuel injection event of a first fuel injection sequence; and (c) reducing the voltage across the actuator at a second rate in order to terminate the initial fuel injection event.

2. The method of claim 1, further comprising the step of:

(d) once the initial fuel injection event has terminated and before a subsequent fuel injection event is initiated, increasing the voltage across the actuator at a third rate so as to energise the actuator but without initiating an injection event.

3. The method of claim 2, wherein the initial fuel injection event is an initial fuel injection event of a first injection sequence and the subsequent fuel injection event is a subsequent fuel injection event of the same injection sequence or wherein the initial fuel injection event is a pilot injection of the first injection sequence and the subsequent injection is a main injection of the first injection sequence, or wherein the initial fuel injection event is a pilot injection of the first injection sequence and the subsequent injection is a further pilot injection of the first injection sequence, or wherein the initial fuel injection event is a fuel injection event of a first injection sequence and the subsequent fuel injection event is a fuel injection event of a second injection sequence.

4. The method of claim 2, including increasing the voltage across the actuator at the third rate as a function of time which has elapsed since the initial fuel injection event.

5. The method of claim 2, wherein in step (d) the rate at which the voltage across the actuator is increased so as to energise the actuator is lower than the first rate at which the voltage across the actuator is increased in step (b).

6. The method of claim 1, wherein:

step (a) comprises applying an initial discharge current to the actuator for an initial period so as to discharge the stack from an initial differential voltage level across the stack to a first differential voltage level across the stack;

step (b) comprises applying a charge current to the actuator for a charge period so as to charge the stack from the first differential voltage level across the stack to a second differential voltage level across the stack;

step (c) comprises applying a discharge current to the actuator for a discharge period so as to discharge the stack from the second differential voltage level to a third differential voltage level;

and wherein in claim 2, step (d) comprises applying a subsequent charge current to the actuator for a subsequent period so as to charge the stack from the third differential voltage level to a subsequent differential voltage level, and wherein the subsequent discharge current is not large enough to initiate a fuel injection event.

7. The method of claim 6, further comprising between steps (b) and (c), the step of:

(b') substantially maintaining the second differential voltage level for a period of time.

8. The method of claim 6, wherein the first differential voltage level and/or the subsequent differential voltage level are selected in dependence on at least one engine parameter, selected from the group consisting of: fuel pressure in the fuel rail; the electric pulse time; the piezoelectric stack temperature, the initial differential voltage level across the stack; engine fuel demand; and intended actuator operating lifespan.

9. The method of claim 1, wherein in step (a) the initial rate at which the voltage across the actuator is reduced so as to de-energise the actuator is lower than the rate at which the voltage across the actuator is reduced in step (c).

10. A computer program product comprising at least one computer program software portion which, when executed in an executing environment, is operable to implement the method of claim 1.

11. A data storage medium having the or each computer program software portion of claim 10 stored thereon.

12. A fuel injector for use in an internal combustion engine, the fuel injector comprising:

an injection control chamber for fuel;

a piezoelectric actuator arranged to control fuel pressure within the control chamber via a load transmission arrangement;

a valve needle which is engageable with a valve needle seat to control fuel injection through a set of nozzle outlets; a surface associated with the valve needle being exposed to fuel pressure within the injection control chamber such that fuel pressure variations within the control chamber control movement of the valve needle relative to the valve needle seat; and a leakage path for fuel into and out of the control chamber from a source of pressurised fuel;

wherein the leakage path is arranged such that, in use, prior to an initial fuel injection event, when the differential voltage across the actuator is changed at a predetermined rate, from an initial differential voltage level in which state the fuel injector is in a non injecting condition to a first differential voltage level, in which state the fuel injector is in a non injecting condition so as to de-energise the actuator, the fuel pressure within the control chamber is not changed sufficiently to alter the state of engagement between the valve needle and the associated valve needle seat; whereas when the differential voltage across the actuator is changed at a second predetermined rate so as to initiate and/or terminate a fuel injection event, the fuel pressure within the control chamber is changed sufficiently to alter the state of engagement between the valve needle and the associated valve needle seat.

13. The fuel injector of claim 12, further comprising a damping arrangement for damping movement of the valve needle.

14. The fuel injector of claim 13, wherein the damping arrangement comprises a damper chamber; the damping arrangement being arranged such that, in use, fuel pressure variations within the damper chamber are damped to a greater extent when the valve needle is caused to disengage the valve needle seat, than when the valve needle is caused to engage the valve needle seat.

15. The fuel injector of claim 14, wherein the damper chamber further comprises a vent passage which provides a flow path from the source of pressurised fuel to the damper chamber and the damping means further comprises a valve member operable between a seated position in which it blocks the flow path provided by the vent passage and an unseated position in which the flow path provided by the vent passage is unblocked.

16. The fuel injector of claim 12, wherein the load transmission arrangement comprises a sleeve member coupled to the actuator, the sleeve member defining a sleeve bore and the control chamber being defined, at least in part, by a surface associated with the valve needle and by the sleeve bore.

17. The fuel injector of claim 16, wherein the leakage path comprises a restricted flow passage formed by a clearance between the valve needle and the sleeve bore.

18. The fuel injector of claim 12, wherein the leakage path comprises a restricted flow passage formed in a component of the fuel injector having a surface exposed to fuel within the control chamber.

19. The fuel injector of claim 12, wherein the leakage path is arranged such that there is a relatively greater restriction to fuel flow out of the control chamber than into the control chamber, such that, in use, the fuel flow rate out of the control chamber during an injection is lower than the fuel flow rate into the control chamber at the end of an injection.

20. A drive circuit for a fuel injector of claim 12, the drive circuit comprising:

(A) a first element or elements for applying an initial discharge current ($I_{INI}$; $I_{INT}$) to the actuator for an initial period prior to an initial fuel injection event so as to discharge the stack from an initial differential voltage level across the stack to a first differential voltage level across the stack;

(B) a second element or elements for applying a charge current to the actuator for a charge period so as to charge the stack from the first differential voltage level across the stack to a second differential voltage level across the stack in order to limit a fuel injection event;

(C) a third element or elements for maintaining the second differential voltage level for period of time;

(D) a fourth element or elements for applying a discharge current to the actuator for a discharge period so as to discharge the stack from the second differential voltage level across the stack to a third differential voltage level across the stack in order to terminate the fuel injection event;

(E) a fifth element or elements for applying a subsequent charge current to the actuator for a subsequent period so as to charge the stack from the third differential voltage level across the stack to a subsequent differential voltage level across the stack;

and wherein the subsequent charge current is not large enough to initiate a fuel injection event.

21. The drive circuit of claim 20, wherein the first differential voltage level and/or the subsequent differential voltage level are selected in dependence on at least one engine parameter, selected from the group consisting of: fuel pressure in the fuel rail; the electric pulse time; the piezoelectric stack temperature; the initial differential voltage level across the stack; engine fuel demand; and intended actuator operating lifespan.

* * * * *